US009689589B2

(12) United States Patent
Minami et al.

(10) Patent No.: US 9,689,589 B2
(45) Date of Patent: Jun. 27, 2017

(54) REFRIGERATION APPARATUS

(71) Applicant: DAIKIN INDUSTRIES, LTD., Osaka-shi, Osaka (JP)

(72) Inventors: Junya Minami, Sakai (JP); Masahiro Oka, Sakai (JP); Mari Susaki, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/114,708

(22) PCT Filed: Jan. 29, 2015

(86) PCT No.: PCT/JP2015/052515

§ 371 (c)(1),
(2) Date: Jul. 27, 2016

(87) PCT Pub. No.: WO2015/115542

PCT Pub. Date: Aug. 6, 2015

(65) Prior Publication Data

US 2016/0341451 A1 Nov. 24, 2016

(30) Foreign Application Priority Data

Jan. 31, 2014 (JP) ..... 2014-017983

(51) Int. Cl.
*F25B 7/00* (2006.01)
*F25B 40/00* (2006.01)
(Continued)

(52) U.S. Cl.
CPC ..... *F25B 7/00* (2013.01); *F25B 13/00* (2013.01); *F25B 40/00* (2013.01); *F25B 40/04* (2013.01);
(Continued)

(58) Field of Classification Search
CPC .. F25B 7/00; F25B 40/00; F25B 49/02; F25B 2700/04; F25B 2341/064; F25B 2400/0419; F25B 2400/0405
See application file for complete search history.

(56) References Cited

U.S. PATENT DOCUMENTS 5,279,131 A * 1/1994 Urushihata ..... F24F 3/065 62/117
7,222,491 B2 * 5/2007 Moriwaki ..... F04B 39/0207 62/117
(Continued)

FOREIGN PATENT DOCUMENTS

JP 2006-292212 A 10/2006
JP 5751355 B1 5/2015

OTHER PUBLICATIONS

International Search Report of corresponding PCT Application No. PCT/JP2015/052515 dated Apr. 28, 2015.
(Continued)

*Primary Examiner* — Jianying Atkisson
*Assistant Examiner* — Kun Kai Ma
(74) *Attorney, Agent, or Firm* — Global IP Counselors, LLP

(57) ABSTRACT

A refrigeration apparatus includes a refrigerant circuit connecting heat-source units in parallel with usage units. First and second heat-source units have first and second compressors, first and second heat-source-side heat exchangers, first and second high-pressure receivers, first and second detecting elements detecting whether the receivers are near flooding, first and second bypass channels returning refrigerant in top parts of the receivers to intake sides of the compressors, and first and second motor-operated valves on the bypass channels, respectively. A controller performs excess refrigerant distribution control in which an opening degree of the first valve is controlled to be greater than an opening degree
(Continued)

of the second valve when the second detecting element detects a nearly flooded state, and the opening degree of the second valve is controlled to be greater than the opening degree of the first valve when the first detecting element detects a nearly flooded state.

11 Claims, 8 Drawing Sheets

(51) Int. Cl.
*F25B 49/02* (2006.01)
*F25B 13/00* (2006.01)
*F25B 40/04* (2006.01)
*F25B 40/06* (2006.01)

(52) U.S. Cl.
CPC ..... *F25B 40/06* (2013.01); *F25B 49/02* (2013.01); *F25B 2341/064* (2013.01); *F25B 2400/0405* (2013.01); *F25B 2400/0419* (2013.01); *F25B 2400/16* (2013.01); *F25B 2700/04* (2013.01)

(56) References Cited

U.S. PATENT DOCUMENTS 8,899,056 B2 * 12/2014 Kawano ..... F25B 13/00 62/149
2003/0066302 A1 * 4/2003 Ueno ..... F04B 39/0207 62/192
2005/0252221 A1 * 11/2005 Mizutani ..... F25B 13/00 62/149
2006/0005570 A1 * 1/2006 Yamada ..... F25B 43/02 62/470
2006/0191286 A1 * 8/2006 Park ..... F25B 13/00 62/434
2009/0025406 A1 * 1/2009 Yoshimi ..... F24F 11/008 62/127
2009/0056358 A1 * 3/2009 Kotani ..... F24F 5/0017 62/259.1
2010/0089085 A1 * 4/2010 Kawano ..... F25B 13/00 62/238.6
2010/0180612 A1 * 7/2010 Kasahara ..... F25B 9/008 62/225
2010/0275626 A1 * 11/2010 Nishimura ..... F25B 49/005 62/149
2010/0293975 A1 * 11/2010 Kawano ..... F25B 13/00 62/149
2011/0000240 A1 * 1/2011 Yamada ..... F25B 49/005 62/208
2011/0048055 A1 * 3/2011 Fujimoto ..... F25B 1/10 62/324.6
2011/0162746 A1 * 7/2011 Zhai ..... F25B 31/004 138/26
2013/0227978 A1 * 9/2013 Kawai ..... F25B 49/02 62/160
2015/0135751 A1 * 5/2015 Tamaki ..... F25B 49/022 62/196.1
2015/0267925 A1 * 9/2015 Inada ..... F25B 13/00 62/509

OTHER PUBLICATIONS

International Preliminary Report of corresponding PCT Application No. PCT/JP2015/052515dated Aug. 11, 2016.
European Search Report of corresponding EP Application No. 15 74 3479.6 dated Mar. 3, 2017.

* cited by examiner

REFRIGERATION APPARATUS

CROSS-REFERENCE TO RELATED APPLICATIONS

This U.S. National stage application claims priority under 35 U.S.C. §119(a) to Japanese Patent Application No. 2014-017983, filed in Japan on Jan. 31, 2014, the entire contents of which are hereby incorporated herein by reference.

TECHNICAL FIELD

The present invention relates to a refrigeration apparatus.

BACKGROUND ART

Refrigeration apparatuses are known in which a high-pressure receiver for accumulating a portion of the refrigerant flowing from a condenser to an evaporator is provided, and excess refrigerant in a refrigerant circuit can thereby be stored, as in the refrigeration apparatus disclosed in (Japanese Laid-open Patent Publication No. 2006-292212.

SUMMARY

Technical Problem

However, the distribution of excess refrigerant accumulated in each of the high-pressure receivers when a plurality of outdoor machines as heat-source units are provided is not addressed in the example described in, Japanese Laid-open Patent Publication No. 2006-292212 configured as described above.

For example, when there are differences in the ease of flow of refrigerant among a plurality of heat source units, large amounts of refrigerant readily collect in the high-pressure receivers of heat source units in which the refrigerant readily flows, and refrigerant does not readily collect in the high-pressure receivers of other heat source units, and the problem emerges that the distribution of excess refrigerant becomes unbalanced. In particular, when too much amount of excess refrigerant collects in one high-pressure receiver, the capacity of the high-pressure receiver is exceeded, and the refrigerant overflows.

The present invention was developed in view of the foregoing problem, and an object of the present invention is to provide a refrigeration apparatus whereby a bias in the amount of excess refrigerant in each of the high-pressure receivers can be suppressed even when a plurality of heat-source units having high-pressure receivers are connected.

Solution to Problem

A refrigeration apparatus according to a first aspect is a refrigeration apparatus having a refrigerant circuit configured by connecting at least two heat-source units in parallel with a usage unit, and has a controller. The usage unit has a usage-side heat exchanger and a usage-side motor-operated valve. The heat-source units have at least a first heat-source unit and a second heat-source unit. The first heat-source unit has a first compressor, a first heat-source-side heat exchanger, a first high-pressure receiver, first detecting means for detecting whether the first high-pressure receiver is near flooding, a first bypass channel for returning refrigerant positioned at a top part in the first high-pressure receiver to an intake side of the first compressor, and a first motor-operated valve provided to the first bypass channel The second heat-source unit has a second compressor, a second heat-source-side heat exchanger, a second high-pressure receiver, second detecting means for detecting whether the second high-pressure receiver is near flooding, a second bypass channel for returning refrigerant positioned at a top part in the second high-pressure receiver to an intake side of the second compressor, and a second motor-operated valve provided to the second bypass channel. The controller performs excess refrigerant distribution control whereby an opening degree of the first motor-operated valve is controlled so as to be greater than the opening degree of the second motor-operated valve when the second detecting means detects a nearly flooded state, while the opening degree of the second motor-operated valve is controlled so as to be greater than the opening degree of the first motor-operated valve when the first detecting means detects a nearly flooded state.

In this refrigeration apparatus, extraction of gas refrigerant from a high-pressure receiver that is nearly flooded among the first high-pressure receiver and the second high-pressure receiver is suppressed relative to extraction of gas refrigerant from the high-pressure receiver other than the nearly flooded high-pressure receiver, and it is thereby possible to suppress drift between each of the high-pressure receivers.

A refrigeration apparatus according to a second aspect is the refrigeration apparatus according to the first aspect, wherein, when the excess refrigerant distribution control is performed, the controller does not close the first motor-operated valve even when the first detecting means detects a nearly flooded state, and does not close the second motor-operated valve even when the second detecting means detects a nearly flooded state.

This refrigeration apparatus is configured so that the corresponding motor-operated valve is not closed even when a nearly flooded state is detected. This configuration makes it possible to regulate the amount of gas refrigerant extracted from a high-pressure receiver that is nearly flooded, and it is therefore possible to regulate the ratio of liquid refrigerant and gas refrigerant in the nearly flooded high-pressure receiver.

A refrigeration apparatus according to a third aspect is the refrigeration apparatus according to the first or second aspect, wherein the first heat-source unit has first heating means for heating refrigerant which has passed through the first motor-operated valve in the first bypass channel, and a first bypass temperature detecting part for detecting the temperature of the refrigerant after the refrigerant is heated by the first heating means in the first bypass channel. The second heat-source unit has second heating means for heating refrigerant that has passed through the second motor-operated valve in the second bypass channel, and a second bypass temperature detecting part for detecting the temperature of the refrigerant after the refrigerant is heated by the second heating means in the second bypass channel. The controller controls the opening degree of the first motor-operated valve and the second motor-operated valve so that the refrigerant heated by the second heating means in the second bypass channel has a predetermined degree of superheat on the basis of the temperature detected by the second bypass temperature detecting part, while the refrigerant heated by the first heating means in the first bypass channel has a predetermined degree of superheat on the basis of the temperature detected by the first bypass temperature detecting part.

In this refrigeration apparatus, the opening degree of the first motor-operated valve is controlled so that the refrigerant flowing through the first bypass channel from the first high-pressure receiver to the intake side of the first compressor has a predetermined degree of superheat, and the opening degree of the second motor-operated valve is controlled so that the refrigerant flowing through the second bypass channel from the second high-pressure receiver to the intake side of the second compressor has a predetermined degree of superheat, while a bias in the amounts of liquid refrigerant each of in the high-pressure receivers is suppressed. It is therefore possible to prevent liquid compression in the first compressor and the second compressor while suppressing drift between the plurality of high-pressure receivers, and to enhance reliability.

A refrigeration apparatus according to a fourth aspect is the refrigeration apparatus according to the third aspect, wherein the first detecting means is configured having a first liquid level detecting channel extending from a part below an end part of the first bypass channel on a side thereof toward the first high-pressure receiver of the first high-pressure receiver, the first liquid level detecting channel merging with the first bypass channel at a position upstream from a position at which the first bypass temperature detecting part is provided. The second detecting means is configured having a second liquid level detecting channel extending from a part below an end part of the second bypass channel on a side thereof toward the second high-pressure receiver of the second high-pressure receiver, the second liquid level detecting channel merging with the second bypass channel at a position upstream from a position at which the second bypass temperature detecting part is provided.

In this refrigeration apparatus, the first bypass temperature detecting part used for suppressing liquid compression in the first compressor can also be applied for use in detecting a nearly flooded state in the first high-pressure receiver, and the second bypass temperature detecting part used for suppressing liquid compression in the second compressor can also be applied for use in detecting a nearly flooded state in the second high-pressure receiver.

A refrigeration apparatus according to a fifth aspect is the refrigeration apparatus according to any of the first through fourth aspects, wherein the controller performs a normal operation mode in which the first motor-operated valve and the second motor-operated valve are both fully closed, and an excess refrigerant control mode for opening at least one of the first motor-operated valve and the second motor-operated valve. The excess refrigerant control mode is started when the degree of subcooling of refrigerant flowing through an outlet of the usage-side heat exchanger is equal to or greater than a predetermined value in a state in which the usage-side heat exchanger is functioning as a refrigerant condenser.

In this refrigeration apparatus, excessive accumulation of liquid refrigerant in the usage-side heat exchanger is suppressed, and it is possible to facilitate enlargement of an effective region used for heat exchange accompanying refrigerant condensation in the usage-side heat exchanger.

In a case in which the amount of refrigerant enclosed in the refrigerant circuit is set in accordance with an air cooling load, it is also possible to facilitate enlargement of the effective region used for heat exchange accompanying refrigerant condensation in the usage-side heat exchanger even when a large excess of refrigerant is likely to occur during air-heating operation.

Advantageous Effects of Invention

In the refrigeration apparatus according to the first aspect, drift between each of the high-pressure receivers can be suppressed.

In the refrigeration apparatus according to the second aspect, it is possible to regulate the ratio of liquid refrigerant and gas refrigerant in the nearly flooded high-pressure receiver.

In the refrigeration apparatus according to the third aspect, it is possible to prevent liquid compression in the first compressor and the second compressor while suppressing drift between the plurality of high-pressure receivers, and to enhance reliability.

In the refrigeration apparatus according to the fourth aspect, prevention of liquid compression and detection of a nearly flooded state can be performed by a shared bypass temperature detecting part.

In the refrigeration apparatus according to the fifth aspect, it is possible to facilitate enlargement of an effective region used for heat exchange accompanying refrigerant condensation in the usage-side heat exchanger.

DESCRIPTION OF EMBODIMENTS

Embodiments of the refrigeration apparatus pertaining to the present invention are described below with reference to the accompanying drawings.

The specific configuration of the refrigeration apparatus according to the present invention is not limited to the following embodiment and modification, and can be changed within a range that does not deviate from the scope of the invention.

(1) Configuration of Refrigeration Apparatus

Figure 1:
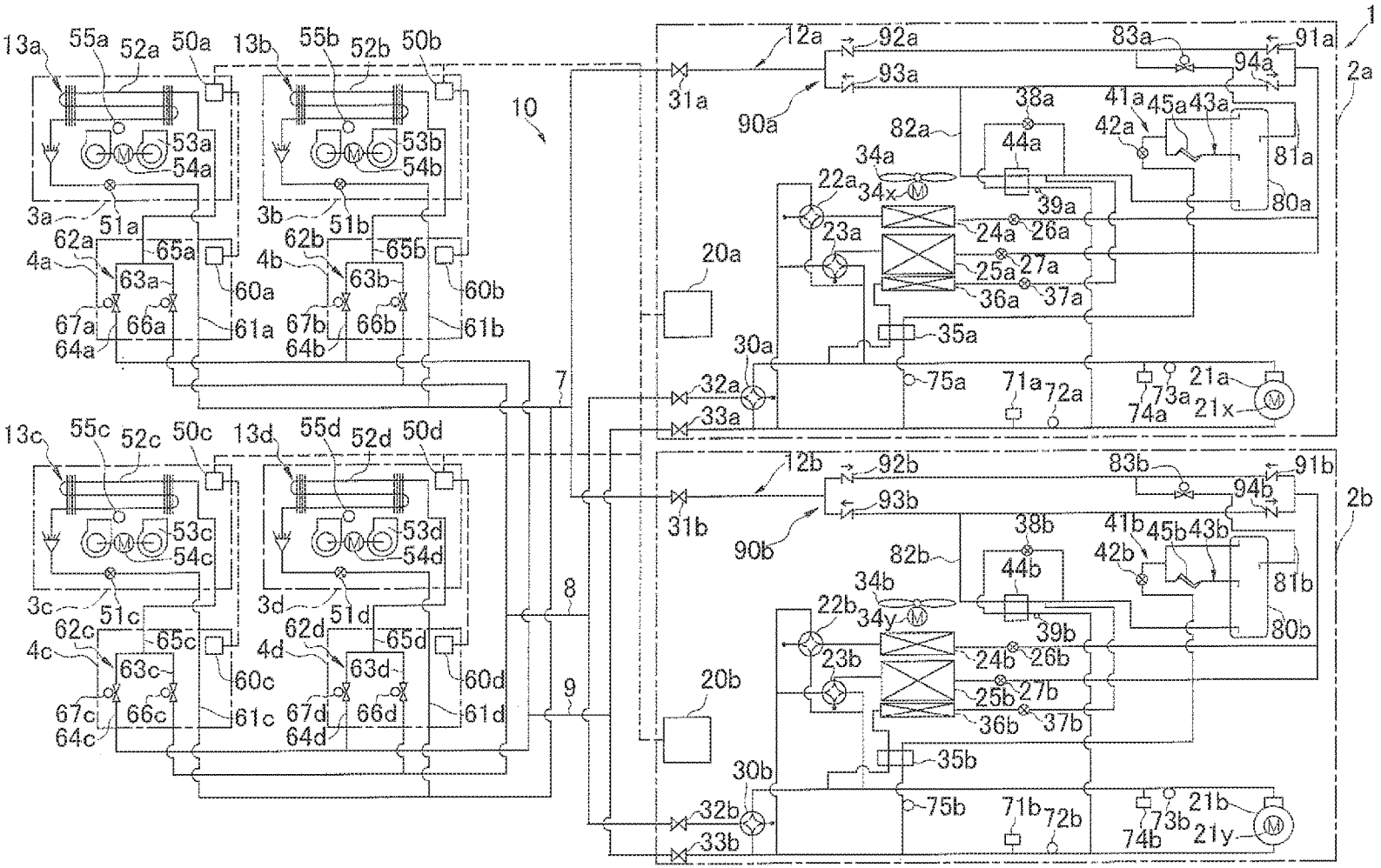
FIG. 1 is a schematic configuration diagram of the refrigeration apparatus as an embodiment of the refrigeration apparatus pertaining to the present invention.
Figure 2:
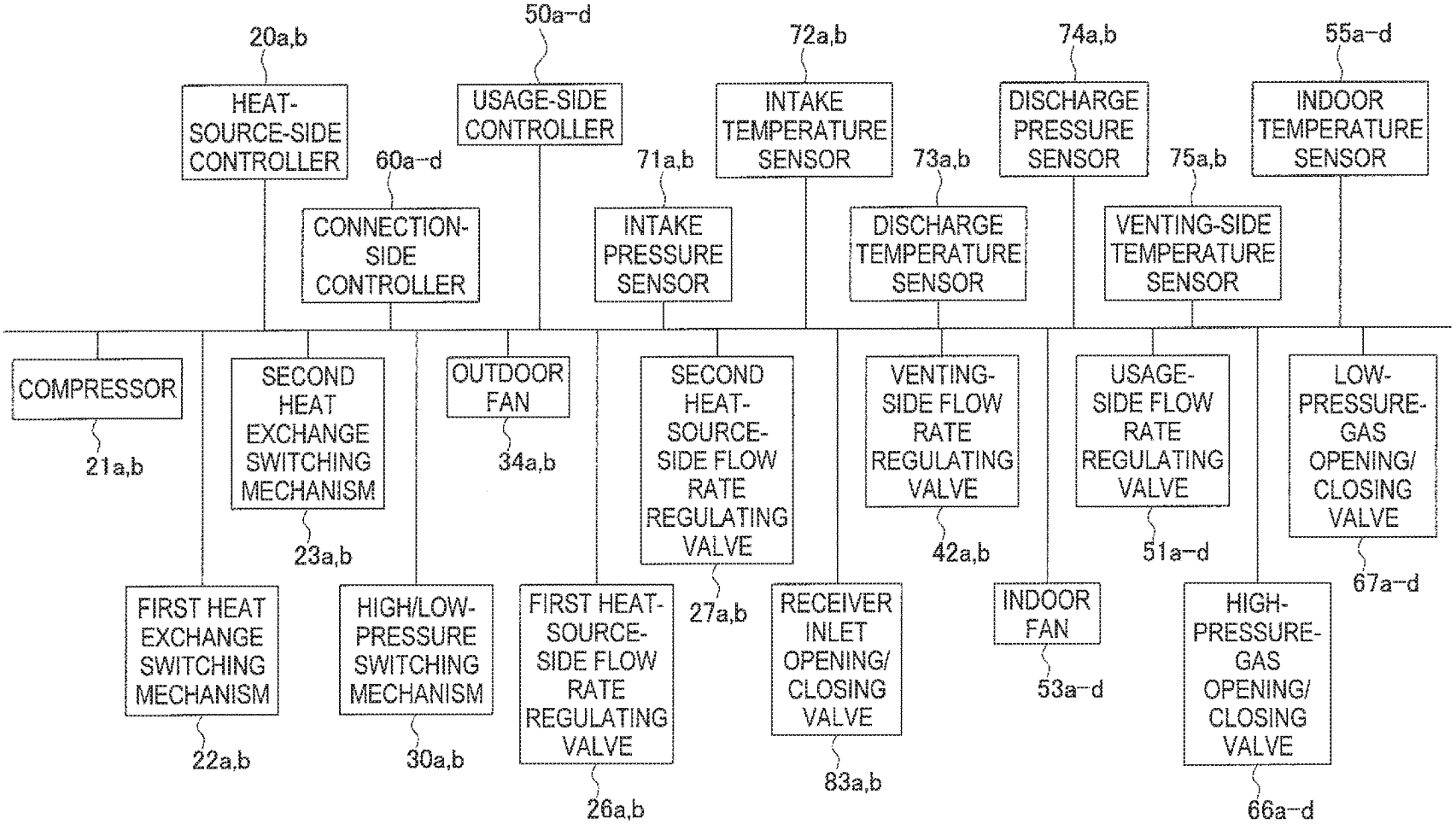
FIG. 2 is a block configuration diagram of the refrigeration apparatus.

FIG. 1 is a schematic configuration diagram of the refrigeration apparatus 1 as an embodiment of the refrigeration apparatus pertaining to the present invention. FIG. 2 is a block configuration diagram of the refrigeration apparatus 1. The refrigeration apparatus 1 is used for indoor air cooling/heating in a building or the like by performing a gas-compression-type refrigerating cycle.

The refrigeration apparatus 1 has primarily a plurality of (two in the present embodiment) heat-source units (first heat-source unit 2*a* and second heat-source unit 2*b*), a plurality of (four in the present embodiment) usage units 3*a*, 3*b*, 3*c*, 3*d*, connecting units 4*a*, 4*b*, 4*c*, 4*d* connected to the usage units 3*a*, 3*b*, 3*c*, 3*d*, and refrigerant communicating tubes 7, 8, 9 for connecting the first heat-source unit 2*a*, the second heat-source unit 2*b*, and the usage units 3*a*, 3*b*, 3*c*, 3*d* via the connecting units 4*a*, 4*b*, 4*c*, 4*d*. Specifically, a gas-compression-type refrigerant circuit 10 of the refrigeration apparatus 1 is configured by the connecting of the first heat-source unit 2*a*, the second heat-source unit 2*b*, the usage units 3*a*, 3*b*, 3*c*, 3*d*, the connecting units 4*a*, 4*b*, 4*c*, 4*d*, and the refrigerant communicating tubes 7, 8, 9. Here, the first heat-source unit 2*a* and the second heat-source unit 2*b* are connected in parallel with each other in the refrigerant circuit 10.

The refrigeration apparatus 1 is also configured so that the usage units 3*a*, 3*b*, 3*c*, 3*d* can individually perform air-cooling operation or air-heating operation, and refrigerant is sent from a usage unit performing air-heating operation to a usage unit performing air-cooling operation, whereby heat can be recovered between the usage units (i.e., simultaneous cooling/heating operation can be performed in which air-cooling operation and air-heating operation are performed simultaneously). The refrigeration apparatus 1 is also configured so that the heat loads of the first heat-source unit 2*a* and the second heat-source unit 2*b* are balanced in accordance with the overall heat load of the plurality of usage units 3*a*, 3*b*, 3*c*, 3*d*, taking into account the heat recovery (simultaneous cooling/heating operation) described above.

(1-1) Usage Units

The usage units 3*a*, 3*b*, 3*c*, 3*d* are installed by being built into or suspended from an indoor ceiling of a building or the like, by hanging on an indoor wall surface, or by other means. The usage units 3*a*, 3*b*, 3*c*, 3*d* are connected to the first heat-source unit 2*a* and the second heat-source unit 2*b* via the refrigerant communicating tubes 7, 8, 9 and the connecting units 4*a*, 4*b*, 4*c*, 4*d*, and constitute a portion of the refrigerant circuit 10.

The configuration of the usage units 3*a*, 3*b*, 3*c*, 3*d* will next be described.

The usage unit 3*a* and the usage units 3*b*, 3*c*, 3*d* have the same configuration. Therefore, only the configuration of the usage unit 3*a* will be described. To refer to the configuration of the usage units 3*b*, 3*c*, 3*d*, the subscripts "b," "c," and "d" are added instead of "a" to the reference signs for indicating the components of the usage unit 3*a*, and the components of the usage units 3*b*, 3*c*, 3*d* will not be described.

The usage unit 3*a* primarily constitutes a portion of the refrigerant circuit 10 and has a usage-side refrigerant circuit 13*a* (usage-side refrigerant circuits 13*b*, 13*c*, 13*d* in the usage units 3*b*, 3*c*, 3*d*, respectively). The usage-side refrigerant circuit 13*a* has primarily a usage-side flow rate regulating valve 51*a* and a usage-side heat exchanger 52*a*.

The usage-side flow rate regulating valve 51*a* is a motor-operated expansion valve, the opening degree of which is regulatable, connected to a liquid side of the usage-side heat exchanger 52*a* in order, inter alia, to regulate the flow rate of refrigerant flowing through the usage-side heat exchanger 52*a*.

The usage-side heat exchanger 52*a* is a device for exchanging heat between the refrigerant and indoor air, and comprises a fin-and-tube heat exchanger configured from a plurality of heat transfer tubes and fins, for example. Here, the usage unit 3*a* has an indoor fan 53*a* for drawing indoor air into the unit and supplying the air to indoors as supply air after heat is exchanged, and is capable of causing heat to be exchanged between the indoor air and the refrigerant flowing through the usage-side heat exchanger 52*a*. The indoor fan 53*a* is driven by an indoor fan motor 54*a*.

The usage unit 3*a* has a usage-side control unit 50*a* for controlling the operation of each of the components 51*a*, 54*a* constituting the usage unit 3*a*. The usage-side controller 50*a* has a microcomputer and/or memory provided for controlling the usage unit 3*a*, and is configured so as to be capable of exchanging control signals and the like with a remote control (not illustrated), and exchanging control signals and the like with the first heat-source unit 2*a* and the second heat-source unit 2*b*.

(1-2) First Heat-Source Unit 2*a* and Second Heat-Source Unit 2*b*

The first heat-source unit 2*a* and the second heat-source unit 2*b* are installed on the roof or elsewhere in a building or the like, for example, are connected in parallel with the usage units 3*a*, 3*b*, 3*c*, 3*d* via the refrigerant communicating tubes 7, 9, and constitute the refrigerant circuit 10 with the usage units 3*a*, 3*b*, 3*c*, 3*d*.

The configuration of the first heat-source unit 2*a* will next be described.

Only the configuration of the first heat-source unit 2*a* will be described. To refer to the configuration of the second heat-source unit 2*b*, the subscript "b" is added instead of "a," and the subscript "y" is added instead of "x" to the reference signs for indicating each of the components of the first heat-source unit 2*a*, and each of the components of the second heat-source unit 2*b* will not be described.

The first heat-source unit 2*a* primarily constitutes a portion of the refrigerant circuit 10 and has a first heat-source-side refrigerant circuit 12*a*. The first heat-source-side refrigerant circuit 12*a* has primarily a first compressor 21*a*, a plurality of (two in this case) first sub-heat-exchange switching mechanisms 22*a*, a first main heat exchange switching mechanism 23*a*, a plurality of (two in this case) first sub-heat-source-side heat exchangers 24*a*, a first main heat-source-side heat exchanger 25*a*, a first sub-heat-source-side flow rate regulating valve 26*a* and a first main-heat-source-side flow rate regulating valve 27*a* corresponding to the two first sub-heat-source-side heat exchangers 24*a* and the first main heat-source-side heat exchanger 25*a*, a first receiver 80*a*, a first bridge circuit 29*a*, a first high/low-pressure switching mechanism 30*a*, a first liquid-side shutoff valve 31*a*, a first high/low-pressure-gas-side shutoff valve 32*a*, a first low-pressure-gas-side shutoff valve 33*a*, a first double-tube heat exchanger 35*a*, a first auxiliary heat-source-side heat exchanger 36*a*, a first auxiliary expansion valve 37*a*, and a first subcooling expansion valve 38*a*.

Here, the first compressor 21*a* is a device for compressing the refrigerant, and comprises a scroll-type or other type of positive-displacement compressor capable of varying an operating capacity by inverter control of a compressor motor 21*x*.

The first sub-heat-exchange switching mechanisms 22*a* comprise four-way switching valves, for example, and are devices capable of switching a flow path of refrigerant in the first heat-source-side refrigerant circuit 12*a* no that a discharge side of the first compressor 21*a* and a gas side of the first sub-heat-source-side heat exchangers 24*a* are connected (as indicated by solid lines in the first sub-heat-exchange switching mechanisms 22*a* in FIG. 1) when the first sub-heat-source-side heat exchangers 24*a* are caused to function as refrigerant condensers (referred to below as a "condensing operation state"), and an intake side of the first compressor 21*a* and the gas side of the first sub-heat-source-side heat exchangers 24*a* are connected (as indicated by broken lines in the first sub-heat-exchange switching mechanisms 22*a* in FIG. 1) when the first sub-heat-source-side heat exchangers 24*a* are caused to function as refrigerant evaporators (referred to below as an "evaporating operation state").

The first main heat exchange switching mechanism 23*a* comprises a four-way switching valve, for example, and is a device capable of switching the flow path of refrigerant in the first heat-source-side refrigerant circuit 12*a* so that the discharge side of the first compressor 21*a* and a gas side of the first main heat-source-side heat exchanger 25*a* are connected (as indicated by solid lines in the first main heat exchange switching mechanism 23*a* in FIG. 1) when the first main heat-source-side heat exchanger 25*a* is caused to function as a refrigerant condenser (referred to below as a "condensing operation state"), and the intake side of the first compressor 21*a* and the gas side of the first main heat-source-side heat exchanger 25*a* are connected (as indicated by broken lines in the first main heat exchange switching mechanism 23*a* in FIG. 1) when the first main heat-source-side heat exchanger 25*a* is caused to function as a refrigerant evaporator (referred to below as an "evaporating operation state").

By changing the switching states of the first sub-heat-exchange switching mechanisms 22*a* and the first main heat exchange switching mechanism 23*a*, the first sub-heat-source-side heat exchangers 24*a* and the first main heat-source-side heat exchanger 25*a* can each individually be switched between functioning as a refrigerant evaporator or a refrigerant condenser.

The first sub-heat-source-side heat exchangers 24*a* are devices for exchanging heat between the refrigerant and outdoor air, and comprise fin-and-tube heat exchangers configured from a plurality of heat transfer tubes and fins, for example. The gas side of the first sub-heat-source-side heat exchangers 24*a* is connected to the first sub-heat-exchange switching mechanisms 22*a*, and the liquid side of the first sub-heat-source-side heat exchangers 24*a* is connected to the first sub-heat-source-side flow rate regulating valve 26*a*.

The first main heat-source-side heat exchangers 25*a* are devices for exchanging heat between the refrigerant and outdoor air, and comprise fin-and-tube heat exchangers configured from a plurality of heat transfer tubes and fins, for example. The gas side of the first main heat-source-side heat exchanger 25*a* is connected to the first main heat exchange switching mechanism 23*a*, and the liquid side of the first main heat-source-side heat exchanger 25*a* is connected to the first main-heat-source-side flow rate regulating valve 27*a*.

The first sub-heat-source-side heat exchangers 36*a* are devices for exchanging heat between the refrigerant and outdoor air, and comprise fin-and-tube heat exchangers configured from a plurality of heat transfer tubes and fins, for example. The gas side of the first auxiliary heat-source-side heat exchanger 36*a* is connected at a position closer to the first high/low-pressure switching mechanism 30*a* described hereinafter than a portion where the discharged refrigerant of the first compressor 21*a* branches toward the first main heat exchange switching mechanism 23*a* and the first high/low-pressure switching mechanism 30*a*. The liquid side of the first auxiliary heat-source-side heat exchanger 36*a* is connected at an intermediate location along a first receiver outlet tube 82*a* between the first receiver 80*a* and a first subcooling heat exchanger 44*a*. The first auxiliary expansion valve 37*a* capable of regulating the amount of refrigerant passing through is provided on the liquid side of the first auxiliary heat-source-side heat exchanger 36*a*. Here, the first auxiliary expansion valve 37*a* comprises an electric expansion valve, the opening degree of which is regulatable.

Here, the first sub-heat-source-side heat exchangers 24*a*, the first main heat-source-side heat exchanger 25*a*, and the first auxiliary heat-source-side heat exchanger 36*a* are configured as an integrated heat-source-side heat exchanger.

The first heat-source unit 2*a* has a first outdoor fan 34*a* for drawing outdoor air into the unit and discharging the air from the unit after heat is exchanged, and is capable of causing heat to be exchanged between the outdoor air and the refrigerant flowing through the first sub-heat-source-side heat exchangers 24*a* and the first main heat-source-side heat exchanger 25*a*. The first outdoor fan 34*a* is driven by a first outdoor fan motor 34*x*, the speed of which can be controlled.

The first sub-heat-source-side flow rate regulating valve 26*a* is an electric expansion valve, the opening degree of which is regulatable, connected to the liquid side of the first sub-heat-source-side heat exchangers 24*a* in order to perform such functions as regulating the flow rate of refrigerant flowing through the first sub-heat-source-side heat exchangers 24*a*.

The first main-heat-source-side flow rate regulating valve 27*a* is an electric expansion valve, the opening degree of which is regulatable, connected to the liquid side of the first main heat-source-side heat exchanger 25*a* in order to perform such functions as regulating the flow rate of refrigerant flowing through the first main heat-source-side heat exchanger 25*a*.

The first auxiliary expansion valve 37*a* is an electric expansion valve, the opening degree of which is regulatable, connected to the liquid side of the first auxiliary heat-source-side heat exchanger 36*a* in order to perform such functions as regulating the flow rate of refrigerant flowing through the first auxiliary heat-source-side heat exchanger 36*a*.

The first receiver 80*a* is a container for temporarily accumulating the refrigerant flowing between the first sub-heat-source-side heat exchangers 24*a*, the first main heat-source-side heat exchanger 25*a*, and the usage-side refrigerant circuits 13*a*, 13*b*, 13*c*, 13*d*. A first receiver inlet tube 81*a* is provided to a top part in the first receiver 80*a*, and a first receiver outlet tube 82*a* is provided to a bottom part of the first receiver 80. A first receiver inlet opening/closing valve 83*a*, the opening and closing of which can be controlled, is provided to the first receiver inlet tube 81*a*. The first receiver inlet tube 81*a* and the first receiver outlet tube 82*a* of the first receiver 80*a* are connected between the first sub-heat-source-side heat exchangers 24*a* and the first main heat-source-side heat exchanger 25*a* and the first liquid-side shutoff valve 31*a* via the first bridge circuit 90*a*.

A first receiver venting tube 41*a* is connected to the first receiver 80*a*. The first receiver venting tube 41*a* is provided so as to extract refrigerant from a top part in the first receiver 80*a* separately from the first receiver outlet tube 82*a*, and connects the top part in the first receiver 80*a* and the intake side of the first compressor 21*a*. A first venting-side flow rate regulating valve 42*a* as a venting-side flow rate regulating mechanism is provided to the first receiver venting tube 41*a* in order to perform such functions as regulating the flow rate of refrigerant vented from the first receiver 80*a*. Here, the first venting-side flow rate regulating valve 42*a* comprises an electric expansion valve, the opening degree of which is regulatable.

A first receiver liquid level detecting tube 43*a* for detecting whether the liquid level in the first receiver 80*a* has reached a predetermined height below the position at which the first receiver venting tube 41*a* is connected is also connected to the first receiver 80*a*. Here, the first receiver liquid level detecting tube 43*a* is provided so as to extract refrigerant from a portion near a middle of the first receiver 80*a* in a height direction thereof. The first receiver liquid level detecting tube 43*a* merges with the first receiver venting tube 41*a* via a first capillary tube 45*a*. Here, the first receiver liquid level detecting tube 43*a* is provided so as to merge with a portion of the first receiver venting tube 41*a* upstream from the position thereof where the first venting-side flow rate regulating valve 42*a* is provided. The first double-tube heat exchanger 35*a* for heating the refrigerant flowing through the first receiver venting tube 41*a* is furthermore provided to the first receiver venting tube 41*a* downstream from the position thereof where the first receiver liquid level detecting tube 43*a* merges.

Here, the first double-tube heat exchanger 35*a* is a heat exchanger for heating the refrigerant flowing through the first receiver venting tube 41*a* using as a heating source the refrigerant which is flowing toward the first auxiliary heat-source-side heat exchanger 36*a* after having been discharged from the first compressor 21 toward the first high/low-pressure switching mechanism 30*a*, and comprises a piping heat exchanger configured by bringing into contact the first receiver venting tube 41*a* and refrigerant piping extending toward the first auxiliary heat-source-side heat exchanger 36*a*, for example. A first venting-side temperature sensor 75*a* for detecting the temperature of refrigerant in the first receiver venting tube 41*a* that has passed through the first double-tube heat exchanger 35*a* is provided to an outlet of the first double-tube heat exchanger 35*a*.

The first subcooling heat exchanger 44*a* is provided at an intermediate location along the first receiver outlet tube 82*a* for discharging liquid refrigerant accumulated in the first receiver 80*a*. A first subcooling circuit branches from between the first receiver 80*a* and the first subcooling heat exchanger 44*a*, and is connected to the intake side of the first compressor 21*a*. In the first subcooling circuit, the first subcooling expansion valve 38*a* is provided between the first subcooling heat exchanger 44*a* and a branching portion with the first receiver outlet tube 82*a*, and it is possible to regulate the degree of subcooling, of refrigerant passing through the first subcooling heat exchanger 44*a* and flowing through the first receiver outlet tube 82*a*. A first subcooling sensor 39*a* capable of detecting the temperature of passing refrigerant is provided in the vicinity of an outlet of the first subcooling heat exchanger 44*a* in the first subcooling circuit, and the opening degree of the first subcooling expansion valve 38*a* is controlled in response to the temperature detected by the first subcooling sensor 39*a*.

The first bridge circuit 90*a* has the function of causing refrigerant to flow into the first receiver 80*a* through the first receiver inlet tube 81*a* and causing refrigerant to flow out from the receiver 80*a* through the first receiver outlet tube 82*a* when refrigerant flows toward the first liquid-side shutoff valve 31*a* from the first sub-heat-source-side heat exchangers 24*a* and the first main heat-source-side heat exchanger 25*a*, as well as when refrigerant flows from the first liquid-side shutoff valve 311*a* toward the first sub-heat-source-side heat exchangers 24*a* and the first main heat-source-side heat exchanger 25*a*. The first bridge circuit 90*a* has four check valves 91*a*, 92*a*, 93*a*, 94*a*. The inlet check valve 91*a* is a check valve for allowing refrigerant to flow only from the first sub-heat-source-side heat exchangers 24*a* and the first main heat-source-side heat exchanger 25*a* to the first receiver inlet tube 81*a*. The inlet check valve 92*a* is a check valve for allowing refrigerant to flow only from the first liquid-side shutoff valve 31*a* to the first receiver inlet tube 81*a*. Specifically, the inlet check valves 91*a*, 92*a* have a function for causing refrigerant to flow from the first sub-heat-source-side heat exchangers 24*a* and the first main heat-source-side heat exchanger 25*a* or the first liquid-side shutoff valve 31*a* to the first receiver inlet tube 81*a*. The outlet check valve 93*a* is a check valve for allowing refrigerant to flow only from the first receiver outlet tube 82*a* to the first liquid-side shutoff valve 31*a*. The outlet check valve 94*a* is a check valve for allowing refrigerant to flow only from the first receiver outlet tube 82*a* to the first sub-heat-source-side heat exchangers 24*a* and the first main heat-source-side heat exchanger 25*a*. Specifically, the outlet check valves 93*a*, 94*a* have a function for causing refrigerant to flow from the first receiver outlet tube 82*a* to the first sub-heat-source-side heat exchangers 24*a* and the first main heat-source-side heat exchanger 25*a* or the first liquid-side shutoff valve 31*a*.

The first high/low-pressure switching mechanism 30*a* comprises a four-way switching valve, for example, and is a device capable of switching the flow path of refrigerant in the first heat-source-side refrigerant circuit 12*a* so that the first high/low-pressure-gas-side shutoff valve 32*a* and the discharge side of the first compressor 21*a* are connected (as indicated by broken lines in the first high/low-pressure switching mechanism 30*a* in FIG. 1) when high-pressure gas refrigerant discharged from the first compressor 21*a* is sent to the usage-side refrigerant circuits 13*a*, 13*b*, 13*c*, 13*d* (referred to below as a "mainly-condensation-load operation state"), and the first high/low-pressure-gas-side shutoff valve 32*a* and the intake side of the first compressor 21*a* are connected (as indicated by solid lines in the first high/low-pressure switching mechanism 30*a* in FIG. 1) when high-pressure gas refrigerant discharged from the first compressor 21*a* is not sent to the usage-side refrigerant circuits 13*a*, 13*b*, 13*c*, 13*d* (referred to below as a "mainly-evaporation-load operation state").

The first liquid-side shutoff valve 31*a*, the first high/low-pressure-gas-side shutoff valve 32*a*, and the first low-pressure-gas-side shutoff valve 33*a* are valves provided to a port for connection with an external device/duct (specifically, the refrigerant communicating tubes 7, 8, 9). The first liquid-side shutoff valve 31*a* is connected to the first receiver inlet tube 81*a* or the first receiver outlet tube 82*a* via the first bridge circuit 90*a*. The first high/low-pressure-gas-side shutoff valve 32*a* is connected to the first high/low-pressure switching mechanism 30*a*. The first low-pressure-gas-side shutoff valve 33*a* is connected to the intake side of the first compressor 21*a*.

The first heat-source unit 2*a* is provided with sensors of various kinds.

Specifically, the first subcooling sensor 39*a* for detecting the temperature of refrigerant in the vicinity of the outlet of the first subcooling heat exchanger 44*a* in the first subcooling circuit, a first intake pressure sensor 71*a* for detecting the pressure of refrigerant on the intake side of the first compressor 21*a*, a first intake temperature sensor 72*a* for detecting the temperature of refrigerant on the intake side of the first compressor 21*a*, a first discharge temperature sensor 73*a* for detecting the temperature of refrigerant on the discharge side of the first compressor 21*a*, a first discharge pressure sensor 74*a* for detecting the pressure of refrigerant on the discharge side of the first compressor 21*a*, and a first venting-side temperature sensor 75*a* for detecting the temperature of refrigerant flowing through the first receiver venting tube 41*a* are provided. Here, the first venting-side temperature sensor 75*a* is provided to the first receiver venting tube 41*a* so as to detect the temperature of refrigerant in the outlet of the first double-tube heat exchanger 35*a*.

The first heat-source unit 2*a* also has a first heat-source-side controller 20*a* for controlling the operation of each of the components 21*x*, 22*a*, 23*a*, 26*a*, 27*a*, 83*a*, 30*a*, 34*x*, and 41*a* constituting the first heat-source unit 2*a*. The first heat-source-side controller 20*a*. has a microcomputer and/or memory provided for controlling the first heat source unit 2*a*, and is configured so as to be capable of exchanging control signals and the like with usage-side controllers 50*a*, 50*b*, 50*c*, 50*d* of the usage units 3*a*, 3*b*, 3*c*, 3*d*, and/or a second heat-source-side controller 20*b* of the second heat source unit 2*b*.

The second heat-source unit 2*b* has the same configuration as the first heat-source unit 2*a*, and the subscript "b" is added instead of "a," and the subscript "y" is added instead of "x" to the reference signs thereof.

Likewise, the second heat-source unit 2*b* has a second heat-source-side refrigerant circuit 12*b*. The second heat-source-side refrigerant circuit 12*b* has primarily a second compressor 21*b*, a plurality of (two in this case) second sub-heat-exchange switching mechanisms 22*b*, a second main heat exchange switching mechanism 23*b*, a plurality of (two in this case) second sub-heat-source-side heat exchangers 24*b*, a second main heat-source-side heat exchanger 25*b*, a second sub-heat-source-side flow rate regulating valve 26*b* and a second main-heat-source-side flow rate regulating valve 27*b* corresponding to the two second sub-heat-source-side heat exchangers 24*b* and the second main heat-source-side heat exchanger 25*b*, a second receiver 80*b*, a second bridge circuit 29*b*, a second high/low-pressure switching mechanism 30*b*, a second liquid-side shutoff valve 31*b*, a second high/low-pressure-gas-side shutoff valve 32*b*, a second low-pressure-gas-side shutoff valve 33*b*, a second double-tube heat exchanger 35*b*, a second auxiliary heat-source-side heat exchanger 36*b*, a second auxiliary expansion valve 37*b*, and a second subcooling expansion valve 38*b*.

When the first sub-heat-exchange switching mechanisms 22*a* are in the "condensing operation state," the second sub-heat-exchange switching mechanisms 22*b* connect a discharge side of the second compressor 21*b* and a gas side of the second sub-heat-source-side heat exchangers 24*b* (as indicated by solid lines in the second sub-heat-exchange switching mechanisms 22*b* in FIG. 1) to cause the second sub-heat-source-side heat exchangers 24*b* to function as refrigerant condensers, the same as above. When the first sub-heat-exchange switching mechanisms 22*a* are in the "evaporating operation state," the second sub-heat-exchange switching mechanisms 22*b* connect an intake side of the second compressor 21*b* and the gas side of the second sub-heat-source-side heat exchangers 24*b* (as indicated by broken lines in the second sub-heat-exchange switching mechanisms 22*b* in FIG. 1) to cause the second sub-heat-source-side heat exchangers 24*b* to function as refrigerant evaporators, the same as above.

When the first main heat exchange switching mechanism 23*a* is in the "condensing operation state," the second main heat exchange switching mechanism 23*b* connects the discharge side of the second compressor 21*b* and the gas side of the second main heat-source-side heat exchanger 25*b* (as indicated by solid lines in the second main heat exchange switching mechanism 23*b* in FIG. 1) to cause the second main heat-source-side heat exchanger 25*b* to function as a refrigerant condenser, the same as above. When the first main heat exchange switching mechanism 23*a* is in the "evaporating operation state," the second main heat exchange switching mechanism 23*b* connects the intake side of the second compressor 21*b* and the gas side of the second main heat-source-side heat exchanger 25*b* (as indicated by broken lines in the second main heat exchange switching mechanism 23*b* in FIG. 1) to cause the second main heat-source-side heat exchanger 25*b* to function as a refrigerant evaporator, the same as above.

Furthermore, when the first high/low-pressure switching mechanism 30*a* is in the "mainly-condensation-load operation state," the second high/low-pressure switching mechanism 30*b* connects the second high/low-pressure gas-side shutoff valve 32*b* and the discharge side of the second compressor 21*b* (as indicated by broken lines in the second high/low-pressure switching mechanism 30*b* in FIG. 1) in order to send high-pressure gas refrigerant discharged from the second compressor 21*b* to the usage-side refrigerant circuits 13*a*, 13*b*, 13*c*, 13*d*, the same as above. When the first high/low-pressure switching mechanism 30*a* is in the "mainly-evaporation-load operation state," the second high/low-pressure switching mechanism 30*b* connects the second high/low-pressure gas-side shutoff valve 32*b* and the intake side of the second compressor 21*b* (as indicated by solid lines in the second high/low-pressure switching mechanism 30*b* in FIG. 1) so that high-pressure gas refrigerant discharged from the second compressor 21*b* is not sent to the usage-side refrigerant circuits 13*a*, 13*b*, 13*c*, 13*d*, the same as above.

A branch tube portion extending from the first liquid-side shutoff valve 31*a* in the liquid refrigerant communicating tube 7 and a branch tube portion extending from the second liquid-side shutoff valve 31*b* in the liquid refrigerant communicating tube 7 merge, and then extend so as to branch toward usage-side heat exchangers 52*a*, 52*b*, 52*c*, 52*d* of the usage units 3*a*, 3*b*, 3*c*, 3*d*.

A branch tube portion extending from the first high/low-pressure-gas-side shutoff valve 32*a* in the high/low-pressure gas refrigerant communicating tube 8 and a branch tube portion extending from the second high/low-pressure gas-side shutoff valve 32*b* in the high/low-pressure gas refrigerant communicating tube 8 merge, and then extend so as to branch toward high-pressure-gas opening/closing valves 66*a*, 66*b*, 66*c*, 66*d* of the connecting units 4*a*, 4*b*, 4*c*, 4*d*, described hereinafter.

Furthermore, a branch tube portion extending from the first low-pressure-gas-side shutoff valve 33*a* in the low-pressure gas refrigerant communicating tube 9 and a branch tube portion extending from the second low-pressure-gas-side shutoff valve 33*b* in the low-pressure gas refrigerant communicating tube 9 merge, and then extend so as to branch toward low-pressure-gas opening/closing valves 67*a*, 67*b*, 67*c*, 67*d* of the connecting units 4*a*, 4*b*, 4*c*, 4*d*, described hereinafter.

(1-3) Connecting Units

The connecting units 4*a*, 4*b*, 4*c*, 4*d* are provided together with the usage units 3*a*, 3*b*, 3*c*, 3*d* inside a building or the like. The connecting units 4*a*, 4*b*, 4*c*, 4*d* are interposed between the usage units 3, 4, 5 and the first heat-source unit 2*a* and second heat-source unit 2*b* together with the refrigerant communicating tubes 7, 8, 9, and constitute a portion of the refrigerant circuit 10.

The configuration of the connecting units 4*a*, 4*b*, 4*c*, 4*d* will next be described.

The connecting unit 4*a* and the connecting units 4*b*, 4*c*, 4*d* have the same configuration. Therefore, only the configuration of the connecting unit 4*a* will be described. To refer to the configuration of the connecting units 4*b*, 4*c*, 4*d*, the subscripts "b," "c," and "d" are added instead of "a" to the reference signs for indicating the components of the connecting unit 4*a*, and the components of the connecting units 4*b*, 4*c*, 4*d* will not be described.

The connecting unit 4*a* primarily constitutes a portion of the refrigerant circuit 10 and has a connection-side refrigerant circuit 14*a* (connection-side refrigerant circuit 14*b*, 14*c*, 14*d* in the connecting units 4*b*, 4*c*, 4*d*, respectively).

The connection-side refrigerant circuit 14*a* has primarily a liquid connecting tube 61*a* and a gas connecting tube 62*a*.

The liquid connecting tube 61*a* connects the liquid refrigerant communicating tube 7 and the usage-side flow rate regulating valve 51*a* of the usage-side refrigerant circuit 13*a*.

The gas connecting tube 62*a* has a high-pressure gas connecting tube 63*a* connected to a high/low-pressure gas refrigerant communicating tube 8, a low-pressure gas connecting tube 64*a* connected to a low-pressure gas refrigerant communicating tube 9, and a merging gas connecting tube 65*a* for merging the high-pressure gas connecting tube 63*a* and the low-pressure gas connecting tube 64*a*. The merging gas connecting tube 65*a* is connected to the gas side of the usage-side heat exchanger 52*a* of the usage-side refrigerant circuit 13*a*. A high-pressure gas opening/closing valve 66*a*, the opening and closing of which can be controlled, is provided to the high-pressure gas connecting tube 63*a*, and a low-pressure gas opening/closing valve 67*a*, the opening and closing of which can be controlled, is provided to the low-pressure gas connecting tube 64*a*.

During air-cooling operation by the usage unit 3*a*, the connecting unit 4*a* can function so that the low-pressure gas opening/closing valve 67*a* is placed in an open state, refrigerant flowing into the liquid connecting tube 61*a* through the liquid refrigerant communicating tube 7 is sent to the usage-side heat exchanger 52*a* through the usage-side flow rate regulating valve 51*a* of the usage-side refrigerant circuit 13*a*, and refrigerant evaporated by heat exchange with indoor air in the usage-side heat exchanger 52*a* is returned to the low-pressure gas refrigerant communicating tube 9 through the merging gas connecting tube 65*a* and the low-pressure gas connecting tube 64*a*.

During air-heating operation by the usage unit 3*a*, the connecting unit 4*a* can function so that the low-pressure gas opening/closing valve 67*a* is closed and the high-pressure gas opening/closing valve 66*a* is placed in an open state, refrigerant flowing into the high-pressure gas connecting tube 63*a* and the merging gas connecting tube 65*a* through the high/low-pressure gas refrigerant communicating tube 8 is sent to the usage-side heat exchanger 52*a* of the usage-side refrigerant circuit 13*a*, and refrigerant condensed by heat exchange with indoor air in the usage-side heat exchanger 52*a* is returned to the liquid refrigerant communicating tube 7 through the usage-side flow rate regulating valve 51*a* and the liquid connecting tube 61*a*.

This function is performed not only by the connecting unit 4*a*, but also by the connecting units 4*b*, 4*c*, 4*d* in the same manner, and the usage-side heat exchangers 52*a*, 52*b*, 52*c*, 52*d* can therefore each individually be switched between functioning as refrigerant evaporators or refrigerant condensers by the connecting units 4*a*, 4*b*, 4*c*, 4*d*.

The connecting unit 4*a* has a connection-side controller 60*a* for controlling the operation of the components 66*a*, 67*a* constituting the connecting unit 4*a*. The connection-side controller 60*a* has a microcomputer and/or memory provided to control the connecting unit 4*a*, and is configured so as to be capable of exchanging control signals and the like with the usage-side control unit 50*a* of the usage unit 3*a*.

The usage-side refrigerant circuits 13*a*, 13*b*, 13*c*, 13*d*, the first heat-source-side refrigerant circuit 12*a*, the second heat-source-side refrigerant circuit 12*b*, the refrigerant communicating tubes 7, 8, 9, and the connection-side refrigerant circuits 14*a*, 14*b*, 14*c*, 14*d* are connected as described above, and constitute the refrigerant circuit 10 of the refrigeration apparatus 1. The refrigeration apparatus 1 is configured as a refrigeration apparatus having a refrigerant circuit including the first compressor 21*a*, the second compressor 21*b*, the first sub-heat-source-side heat exchangers 24*a*, the first main heat-source-side heat exchanger 25*a*, the second sub-heat-source-side heat exchangers 24*b*, the second main heat-source-side heat exchanger 25*b*, the first receiver 80*a*, the second receiver 80*b*, the usage-side heat exchangers 52*a*, 52*b*, 52*c*, 52*d*, the first receiver venting tube 41*a* for connecting the top part in the first receiver 80*a* and the intake side of the first compressor 21*a*, and a second receiver venting tube 41*b* for connecting a top part in the second receiver 80*b* and the intake side of the second compressor 21*b*.

Here, it is possible to perform refrigerating cycle operation while venting gas refrigerant from the second receiver 80*b* to the intake side of the second compressor 21*b* through the second receiver venting tube 41*b*, while venting gas refrigerant from the first receiver 80*a* to the intake side of the first compressor 21*a* through the first receiver venting tube 41*a*, as described hereinafter.

As described above, a first receiver liquid level detecting tube 43*a* for detecting whether the liquid level in the first receiver 80*a* has reached a predetermined height below the position at which the first receiver venting tube 41*a* is connected also extends from inside the first receiver 80*a*, The first receiver liquid level detecting tube 43*a* merges with the first receiver venting tube 41*a* via the first capillary tube 45*a*. It is therefore possible to detect whether the liquid level in the first receiver 80*a* has reached a predetermined height below the position at which the first receiver venting tube 41*a* is connected, on the basis of the temperature of the refrigerant which flows through the first receiver venting tube 41*a* after merging of the refrigerant extracted from the first receiver liquid level detecting tube 43*a* with the refrigerant extracted from the first receiver venting tube 41*a*, as described hereinafter.

In the same manner in the second receiver 80*b* as well, a second receiver liquid level detecting tube 43*b* for detecting whether the liquid level in the second receiver 80*b* has reached a predetermined height below the position at which the second receiver venting tube 41*b* is connected extends from inside the second receiver 80*b*. The second receiver liquid level detecting tube 43*b* merges with the second receiver venting tube 41*b* via a second capillary tube 45*b*. It is therefore possible to detect whether the liquid level in the second receiver 80*b* has reached a predetermined height below the position at which the second receiver venting tube 41*b* is connected, on the basis of the temperature of the refrigerant which flows through the second receiver venting tube 41*b* after merging of the refrigerant extracted from the second receiver liquid level detecting tube 43*b* with the refrigerant extracted from the second receiver venting tube 41*b*.

(2) Configuration of Refrigeration Apparatus

The operation of the refrigeration apparatus 1 will next be described.

The refrigerating cycle operation of the refrigeration apparatus 1 includes air-cooling operation, air-heating operation, simultaneous cooling/heating operation (mainly evaporation load), and simultaneous cooling/heating operation (mainly condensation load).

Here, air-cooling operation is operation in which only usage units performing air-cooling operation (i.e., operation in which a usage-side heat exchanger functions as a refrigerant evaporator) are present, and the first sub-heat-source-side heat exchangers 24*a*, the first main heat-source-side heat exchanger 25*a*, the second sub-heat-source-side heat exchangers 24*b*, and the second main heat-source-side heat exchanger 25*b* are caused to function as refrigerant condensers for the overall evaporation load of the usage units.

Air-heating operation is operation in which only usage units performing air-heating operation (i.e., operation in which a usage-side heat exchanger functions as a refrigerant condenser) are present, and the first sub-heat-source-side heat exchangers 24*a*, the first main heat-source-side heat exchanger 25*a*, the second sub-heat-source-side heat exchangers 24*b*, and the second main heat-source-side heat exchanger 25*b* are caused to function as refrigerant evaporators for the overall condensation load of the usage units.

Simultaneous cooling/heating operation (mainly evaporation load) is operation in which the first sub-heat-source-side heat exchangers 24*a*, the first main heat-source-side heat exchanger 25*a*, the second sub-heat-source-side heat exchangers 24*b*, and the second main heat-source-side heat exchanger 25*b* are caused to function as refrigerant condensers for the overall evaporation load of the usage units when there is a mixture of usage units performing air-cooling operation (i.e., operation in which a usage-side heat exchanger functions as a refrigerant evaporator) and usage units performing air-heating operation (i.e., operation in which a usage-side heat exchanger functions as a refrigerant condenser), and the overall heat load of the usage units is mainly an evaporation load.

Simultaneous cooling/heating, operation (mainly condensation load) is operation in which the first sub-heat-source-side heat exchangers 24*a*, the first main heat-source-side heat exchanger 25*a*, the second sub-heat-source-side heat exchangers 24*b*, and the second main heat-source-side heat exchanger 25*b* are caused to function as refrigerant evaporators for the overall evaporation load of the usage units when there is a mixture of usage units performing air-cooling operation(i.e., operation in which a usage-side heat exchanger functions as a refrigerant evaporator) and usage units performing air-heating operation (i.e., operation in which a usage-side heat exchanger functions as a refrigerant condenser), and the overall heat load of the usage units is mainly a condensation load.

The operation of the refrigeration apparatus 1 including these refrigerating cycle operations is performed by the controllers 20, 50*a*, 50*b* 50*c*, 50*d*, 60*a*, 60*b*, 60*c*, 60*d* described above.

(2-1) Cooling Mode

Figure 3:
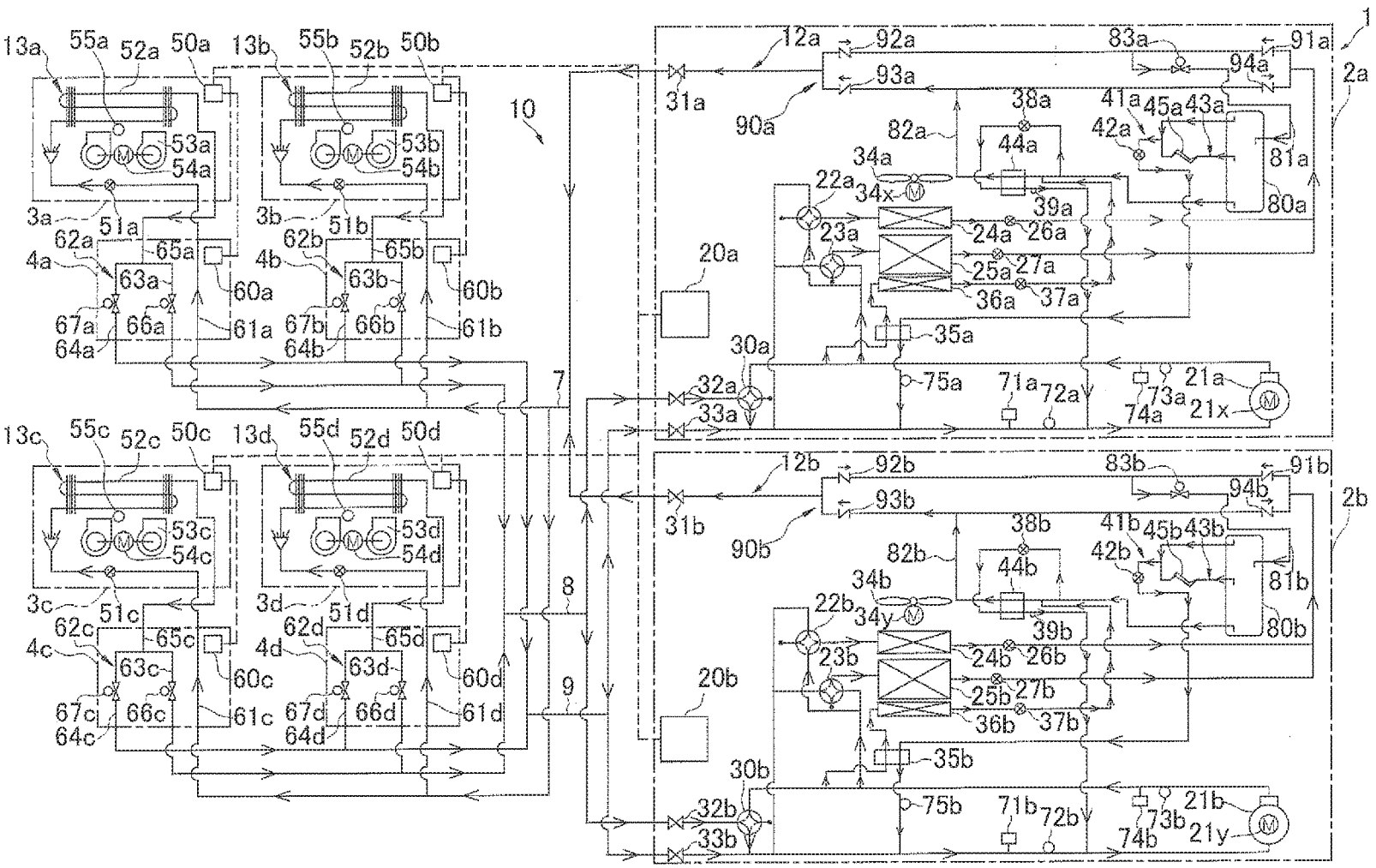
FIG. 3 is a view illustrating operation (refrigerant flow) in air-cooling operation.

During air-cooling operation e.g., when all of the usage units 3*a*, 3*b*, 3*c*, 3*d* are performing air-cooling operation (i.e., operation in which all of the usage-side heat exchangers 52*a*, 52*b*, 52*c*, 52*d* function as refrigerant evaporators) and the first sub-heat-source-side heat exchangers 24*a*, the first main heat-source-side heat exchanger 25*a*, the second sub-heat-source-side heat exchangers 24*b*, and the second main heat-source-side heat exchanger 25*b* function as refrigerant condensers, the refrigerant circuit 10 of the refrigeration apparatus 1 is configured as illustrated in FIG. 3 (the flow of refrigerant being illustrated by arrows drawn in the refrigerant circuit 10 in FIG. 3).

Specifically, in the first heat-source unit 2*a* (the same as in the second heat-source unit 2*b*), the first sub-heat-exchange switching mechanisms 22*a* are switched to a condensing operation state (indicated by solid lines in the first sub-heat-exchange switching mechanisms 22*a* in FIG. 3) and the first main heat exchange switching mechanism 23*a* is switched to a condensing operation state (indicated by solid lines in the first main heat exchange switching mechanism 23*a* in FIG. 3), whereby the first sub-heat-source-side heat exchangers 24*a* and the first main heat-source-side heat exchanger 25*a* are caused to function as refrigerant condensers. The first high/low-pressure switching mechanism 30*a* is also switched to a mainly-evaporation-load operation state (indicated by solid lines in the first high/low-pressure switching mechanism 30*a* in FIG. 3). The first sub-heat-source-side flow rate regulating valve 26*a* and the first main-heat-source-side flow rate regulating valve 27*a* are regulated in terms of valve opening, and the first receiver inlet opening/closing valve 83*a* is in an open state. Furthermore, the opening degree of the first auxiliary expansion valve 37*a* is regulated, and it is thereby possible to regulate the flow rate of refrigerant in the first auxiliary heat-source-side heat exchanger 36*a*. The opening degree of the first venting-side flow rate regulating valve 42*a* as the first venting-side flow rate regulating mechanism is regulated so as to suppress the intake of wet refrigerant into the first compressor 21*a* on the basis of a value detected by the first venting-side temperature sensor 75*a*, and it is thereby possible to regulate the amount of heat exchange in the first double-tube heat exchanger 35*a*, and the amount of gas refrigerant extracted through the first receiver venting tube 41*a* from the first receiver 80*a* to the intake side of the first compressor 21*a* is regulated. The opening degree of the first subcooling expansion valve 38*a* is also regulated on the basis of the temperature detected by the first subcooling sensor 39*a*, and it is thereby possible to regulate the degree of subcooling of refrigerant flowing through an outlet of the first subcooling heat exchanger 44*a* of the first receiver outlet tube 82*a*. In the connecting units 4*a*, 4*b*, 4*c*, 4*d*, the high-pressure-gas opening/closing valves 66*a*, 66*b*, 66*c*, 66*d* and the low-pressure-gas opening/closing valves 67*a*, 67*b*, 67*c*, 67*d* are placed in an open state, whereby all of the usage-side heat exchangers 52*a*, 52*b*, 52*c*, 52*d* of the usage units 3*a*, 3*b*, 3*c*, 3*d* are caused to function as refrigerant evaporators, and all of the usage-side heat exchangers 52*a*, 52*b*, 52*c*, 52*d* of the usage units 3*a*, 3*b*, 3*c*, 3*d* and the intake side of the first compressor 21*a* of the first heat-source unit 2*a* and the intake side of the second compressor 21*b* of the second heat-source unit 2*b* are connected via the high/low-pressure gas refrigerant communicating tube 8 and the low-pressure gas refrigerant communicating tube 9. In the usage units 3*a*, 3*b*, 3*c*, 3*d*, the opening degrees of the usage-side flow rate regulating valves 51*a*, 51*b*, 51*c*, 51*d* are regulated by the first heat-source-side controller 20*a* and the second heat-source-side controller 20*b* so that the degree of superheat of the refrigerant flowing through the outlets of the usage-side heat exchangers 52*a*, 52*b*, 52*c*, 52*d* is at a predetermined value, for example.

In the refrigerant circuit 10 thus configured, a portion of high-pressure gas refrigerant compressed and discharged by the first compressor 21*a* is sent to the first sub-heat-source-side heat exchangers 24*a* and the first main heat-source-side heat exchanger 25*a* through the first main heat exchange switching mechanism 23*a*, and another portion of the refrigerant is sent to the first auxiliary heat-source-side heat exchanger 36*a* through the first double-tube heat exchanger 35*a*. The high-pressure gas refrigerant sent to the first sub-heat-source-side heat exchangers 24*a* and the first main heat-source-side heat exchanger 25*a* is then condensed in the first sub-heat-source-side heat exchangers 24*a* and the first main heat-source-side heat exchanger 25*a* by heat exchange with outdoor air supplied as a heat source by the first outdoor fan 34*a*. After the flow rate of the refrigerant condensed in the first sub-heat-source-side heat exchangers 24*a* and the first main heat-source-side heat exchanger 25*a* is regulated in the first sub-heat-source-side flow rate regulating valve 26*a* and the first main-heat-source-side flow rate regulating valve 27*a*, the refrigerant is merged and sent to the first receiver 80*a* through the inlet check valve 91*a* and the first receiver inlet opening/closing valve 83*a*. The refrigerant sent to the first receiver 80*a* is temporarily accumulated in the first receiver 80*a* and separated into gas and liquid, the gas refrigerant passes through the first receiver venting tube 41*a* and is heat-exchanged in the first double-tube heat exchanger 35*a*, and is then extracted to the intake side of the first compressor 21*a*, and the liquid refrigerant is passed through the first receiver outlet tube 82*a* and sent to the liquid refrigerant communicating tube 7 through the outlet check valve 93*a* and the first liquid-side shutoff valve 31*a*. The refrigerant condensed in the first double-tube heat exchanger 35*a* and the first auxiliary heat-source-side heat exchanger 36*a* merges in an intermediate location along the first receiver outlet tube 82*a*. High-pressure gas refrigerant compressed and discharged by the second compressor 21*b* flows in the same manner, and is subsequently sent to the liquid refrigerant communicating tube 7 through the second liquid-side shutoff valve 31*b*, and merges with refrigerant sent from the first heat-source unit 2*a*.

The refrigerant sent to the liquid refrigerant communicating tube 7 is branched into four streams and sent to the liquid connecting tubes 61*a*, 61*b*, 61*c*, 61*d* of the connecting units 4*a*, 4*b*, 4*c*, 4*d*. The refrigerant sent to the liquid connecting tubes 61*a*, 61*b*, 61*c*, 61*d* is then sent to the usage-side flow ate regulating valves 51*a*, 51*b*, 51*c*, 51*d* of the usage units 3*a*, 3*b*, 3*c*, 3*d*.

After the flow rate of the refrigerant sent to the usage-side flow rate regulating valves 51*a*, 51*b*, 51*c*, 51*d* is regulated in the usage-side flow rate regulating valves 51*a*, 51*b*, 51*c*, 51*d*, the refrigerant is evaporated in the usage-side heat exchangers 52*a*, 52*b*, 52*c*, 52*d* by heat exchange with indoor air supplied by the indoor fans 53*a*, 53*b*, 53*c*, 53*d*, and becomes low-pressure gas refrigerant. Meanwhile, the indoor air is cooled and supplied indoors, and air-cooling operation by the usage units 3*a*, 3*b*, 3*c*, 3*d* is performed. The low-pressure gas refrigerant is then sent to the merging gas connecting tubes 65*a*, 65*b*, 65*c*, 65*d* of the connecting units 4*a*, 41*b*, 4*c*, 4*d*.

The low-pressure gas refrigerant sent to the merging gas connecting tubes 65*a*, 65*b*, 65*c*, 65*d* is then sent to the high/low-pressure gas refrigerant communicating tube 8 through the high-pressure gas opening/closing valves 66*a*, 66*b*, 66*c*, 66*d* and the high-pressure gas connecting tubes 63*a*, 63*b*, 63*c*, 63*d* and merged, and also sent to the low-pressure gas refrigerant communicating tube 9 through the low-pressure gas opening/closing valves 67*a*, 67*b*, 67*c*, 67*d* and the low-pressure gas connecting tubes 64*a*, 64*b*, 64*c*, 64*d* and merged.

Low-pressure gas refrigerant sent to the gas refrigerant communicating tubes 8, 9 is then branched so as to flow to the first heat-source unit 2*a* and the second heat-source unit 2*b*. In the first heat-source unit 2*a*, the refrigerant is then returned to the intake side of the first compressor 21*a* through the first high/low-pressure-gas-side shutoff valve 32*a*, the first low-pressure-gas-side shutoff valve 33*a*. and the first high/low-pressure switching mechanism 30*a*, and, in the second heat-source unit 2*b*, the refrigerant is returned to the intake side of the second compressor 21*b* through the second high/low-pressure-gas-side shutoff valve 32*b*, the second low-pressure-gas-side shutoff valve 33*b*, and the second high/low-pressure switching mechanism 30*b*.

Air-cooling operation is performed in the manner described above.

In air-cooling operation, a target evaporation temperature is set for the first compressor 21*a* and the second compressor 21*b* so that an air cooling load in all of the usage-side heat exchangers 52*a*, 52*b*, 52*c*, 52*d* functioning as refrigerant evaporators can be processed, and the frequency of the first compressor 21*a* and the second compressor 21*b* is controlled so that the target evaporation temperature can be realized.

By a configuration in which some of the usage units 3*a*, 3*b*, 3*c*, 3*d* perform air-cooling operation (i.e., operation in which some of the usage-side heat exchangers 52*a*, 52*b*, 52*c*, 52*d* function as refrigerant evaporators), when the overall evaporation load of the usage-side heat exchangers 52*a*, 52*b*, 52*c*, 52*d* is small, operation is performed in which either the first sub-heat-source-side heat exchangers 24*a* or the first main heat-source-side heat exchanger 25*a* (e.g., only the first sub-heat-source-side heat exchangers 24*a*) is caused to function as a refrigerant condenser (same as the second heat-source unit 2*b*).

(2-2) Heating Operation

Figure 4:
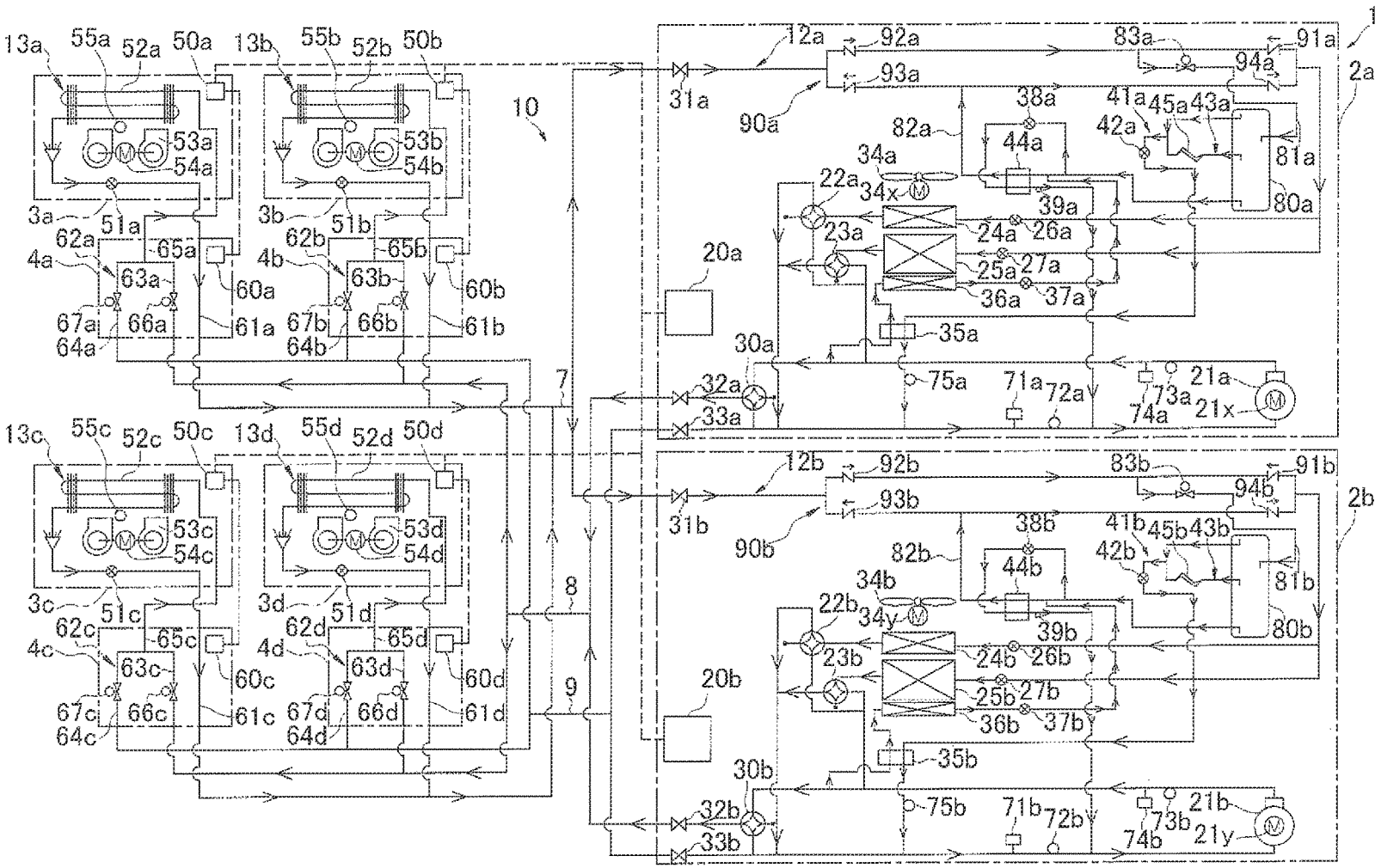
FIG. 4 is a view illustrating operation (refrigerant flow) in air-heating operation.

During air-heating operation e.g., when all of the usage units 3*a*, 3*b*, 3*c*, 3*d* are performing air-heating operation (i.e., operation in which all of the usage-side heat exchangers 52*a*, 52*b*, 52*c*, 52*d* function as refrigerant condensers) and the first sub-heat-source-side heat exchangers 24*a*, the first main heat-source-side heat exchanger 25*a*, the second sub-heat-source-side heat exchangers 24*b*, and the second main heat-source-side heat exchanger 25*b* function as refrigerant evaporators, the refrigerant circuit 10 of the refrigeration apparatus 1 is configured as illustrated in FIG. 4 (the flow of refrigerant being illustrated by arrows drawn in the refrigerant circuit 10 in FIG. 4).

Specifically, in the first heat-source unit 2*a*, the first sub-heat-exchange switching mechanisms 22*a* are switched to an evaporating operation state (indicated by broken lines in the first sub-heat-exchange switching mechanisms 22*a* in FIG. 4) and the first main heat exchange switching mechanism 23*a* is switched to an evaporating operation state (indicated by broken lines in the first main heat exchange switching mechanism 23*a* in FIG. 4), whereby the first sub-heat-source-side heat exchangers 24*a* and the first main heat-source-side heat exchanger 25*a* are caused to function as refrigerant evaporators. The first high/low-pressure switching mechanism 30*a* is also switched to a mainly-condensation-load operation state (indicated by broken lines in the first high/low-pressure switching mechanism 30*a* in FIG. 4). The first sub-heat-source-side flow rate regulating valve 26*a* and the first main-heat-source-side flow rate regulating valve 27*a* are regulated in terms of valve opening, and the first receiver inlet opening/closing valve 83*a* is in an open state. Furthermore, the opening degree of the first auxiliary expansion valve 37*a* is regulated, and it is thereby possible to regulate the flow rate of refrigerant in the first auxiliary heat-source-side heat exchanger 36*a*. The opening degree of the first venting-side flow rate regulating valve 42*a* as the first venting-side flow rate regulating mechanism is regulated so as to suppress the intake of wet refrigerant into the first compressor 21*a* on the basis of a value detected by the first venting-side temperature sensor 75*a*, and it is thereby possible to regulate the amount of heat exchange in the first double-tube heat exchanger 35*a*, and the amount of gas refrigerant extracted through the first receiver venting tube 41*a* from the first receiver 80*a* to the intake side of the first compressor 21*a* is regulated. The opening degree of the first subcooling expansion valve 38*a* is also regulated on the basis of the temperature detected by the first subcooling sensor 39*a*, and it is thereby possible to regulate the degree of subcooling of refrigerant flowing through an outlet of the first subcooling heat exchanger 44*a* of the first receiver outlet tube 82*a*. In the connecting units 4*a*, 4*b*, 4*c*, 4*d*, the high-pressure-gas opening/closing valves 66*a*, 66*b*, 66*c*, 66*d* are placed in the open state and the low-pressure-gas opening/closing valves 67*a*, 67*b*, 67*c*, 67*d* are placed in the closed open state, whereby all of the usage-side heat exchangers 52*a*, 52*b*, 52*c*, 52*d* of the usage units 3*a*, 3*b*, 3*c*, 3*d* are caused to function as refrigerant condensers, and all of the usage-side heat exchangers 52*a*, 52*b*, 52*c*, 52*d* of the usage units 3*a*, 3*b*, 3*c*, 3*d* and the discharge side of the first compressor 21*a* of the first heat-source unit 2*a* and the discharge side of the second compressor 21*b* of the second heat-source unit 2*b* are connected via the high/low-pressure gas refrigerant communicating tube 8. In the usage units 3*a*, 3*b*, 3*c*, 3*d*, the opening degrees of the usage-side flow rate regulating valves 51*a*, 51*b*, 51*c*, 51*d* are regulated by the first heat-source-side controller 20*a* and the second heat-source-side controller 20*b* so that the degree of subcooling of the refrigerant flowing through the outlets of the usage-side heat exchangers 52*a*, 52*b*, 52*c*, 52*d* is at a predetermined value, for example.

In the refrigerant circuit 10 thus configured, a portion of the high-pressure gas refrigerant compressed and discharged by the first compressor 21*a* is sent to the high/low-pressure gas refrigerant communicating tube 8 through the first high/low-pressure switching mechanism 30*a* and the first high/low-pressure-gas-side shutoff valve 32*a*, and the another portion of the refrigerant is sent to the first auxiliary heat-source-side heat exchanger 36*a* through the first double-tube heat exchanger 35*a*. In the same manner, a portion of the high-pressure gas refrigerant compressed and discharged by the second compressor 21*b* is sent through the second high/low-pressure switching mechanism 30*b* and the second high/low-pressure-gas-side shutoff valve 32*b*, and another portion of the refrigerant is sent to the high/low-pressure gas refrigerant communicating tube 8 through the first double-tube heat exchanger 35*a* and the first auxiliary heat-source-side heat exchanger 36*a*.

The high-pressure gas refrigerant sent to the high/low-pressure gas refrigerant communicating tube 8 is branched into four streams and sent to the high-pressure gas connecting tubes 63*a*, 63*b*, 63*c*, 63*d* of the connecting units 4*a*, 4*b*, 4*c*, 4*d*. The high-pressure gas refrigerant sent to the high-pressure gas connecting tubes 63*a*, 63*b*, 63*c*, 63*d* is then sent to the usage-side heat exchangers 52*a*, 52*b*, 52*c*, 52*d* of the usage units 3*a*, 3*b*, 3*c*, 3*d* through the high-pressure gas opening/closing valves 66*a*, 66*b*, 66*c*, 66*d* and the merging gas connecting tubes 65*a*, 6*b*, 65*c*, 65*d*.

The high-pressure gas refrigerant sent to the usage-side heat exchangers 52*a*, 52*b*, 52*c*, 52*d* is then condensed in the usage-side heat exchangers 52*a*, 52*b*, 52*c*, 52*d* by heat exchange with indoor air supplied by the indoor fans 53*a*, 53*b*, 53*c*, 53*d*. Meanwhile, the indoor air is heated and supplied indoors, and air-heating operation by the usage units 3*a*, 3*b*, 3*c*, 3*d* is performed. After the flow rate of the refrigerant condensed in the usage-side heat exchangers 52*a*, 52*b*, 52*c*, 52*d* is regulated in the usage-side flow rate regulating valves 51*a*, 51*b*, 51*c*, 51*d*, the refrigerant is sent to the liquid connecting tubes 61*a*, 61*b*, 61*c*, 61*d* of the connecting units 4*a*, 4*b*, 4*c*, 4*d*.

The refrigerant sent to the liquid connecting tubes 61*a*, 61*b*, 61*c*, 61*d* is then sent to the liquid refrigerant communicating tube 7 and merged.

The refrigerant sent to the liquid refrigerant communicating tube 7 is then branched so as to flow to the firs-t heat-source unit 2*a* and the second heat-source unit 2*b*. in the first heat-source unit 2*a*, the refrigerant is then sent to the first receiver 80*a* through the first liquid-side shutoff valve 31*a*, the inlet check valve 92*a*, and the first receiver inlet opening/closing valve 83*a*. The refrigerant sent to the first receiver 80*a* is temporarily accumulated in the first receiver 80*a* and separated into gas and liquid, the gas refrigerant passes through the first receiver venting tube 41*a* and is heat-exchanged in the first double-tube heat exchanger 35*a*, and is then extracted to the intake side of the first compressor 21*a*, and the liquid refrigerant is passed through the first receiver outlet tube 82*a* and sent to both the first sub-heat-source-side flow rate regulating valve 26*a* and the first main heat-source-side flow rate regulating valve a through the outlet check valve 94*a*.

The refrigerant condensed in the first double-tube heat exchanger 35*a* and the first auxiliary heat-source-side heat exchanger 36*a* merges in an intermediate location along the first receiver outlet tube 82*a*.

After the flow rate of the refrigerant sent to the first sub-heat-source-side flow rate regulating valve 26*a* and the first main heat-source-side flow rate regulating valve 27*a* is regulated in the first sub-heat-source-side flow rate regulating valve 26*a* and the first main heat-source-side flow rate regulating valve 27*a*, the refrigerant is evaporated in the first sub-heat-source-side heat exchangers 24*a* and the first main heat-source-side heat exchanger 25*a* by heat exchange with outdoor air supplied by the first outdoor fan 34*a*, and becomes low-pressure gas refrigerant, and is sent to the first sub-heat-exchange switching mechanisms 22*a* and the first main heat exchange switching mechanism 23*a*. The low-pressure gas refrigerant sent to the first sub-heat-exchange switching mechanisms 22*a* and the first main heat exchange switching mechanism 23*a* is then merged and returned to the intake side of the first compressor 21*a*. The second heat-source unit 2*b* is configured in the same manner.

Air-heating operation is performed in the manner described above.

In air-heating operation, a target condensation temperature is net for the first compressor 21*a* and the second compressor 21*b* so that an air heating load in all of the usage-side heat exchangers 52*a*, 52*b*, 52*c*, 52*d* functioning as refrigerant condensers can be processed, and the frequency of the first compressor 21*a* and the second compressor 21*b* is controlled so that the target condensation temperature can be realized.

By a configuration in which some of the usage units 3*a*, 3*b*, 3*c*, 3*d* perform air-heating operation (i.e., operation in which some of the usage-side heat exchangers 52*a*, 52*b*, 52*c*, 52*d* function as refrigerant condensers), when the overall condensation load of the usage-side heat exchangers 52*a*, 52*b*, 52*c*, 52*d* is small, operation is performed in which either the first sub-heat-source-side heat exchangers 24*a* or the first main heat-source-side heat exchanger 25*a* (e.g., only the first sub-heat-source-side heat exchangers 24*a*) is caused to function as a refrigerant evaporator (the second heat-source unit 2*b* being configured in the same manner).

(2-3) Simultaneous Cooling/Heating Operation (Mainly Evaporation Load)

Figure 5:
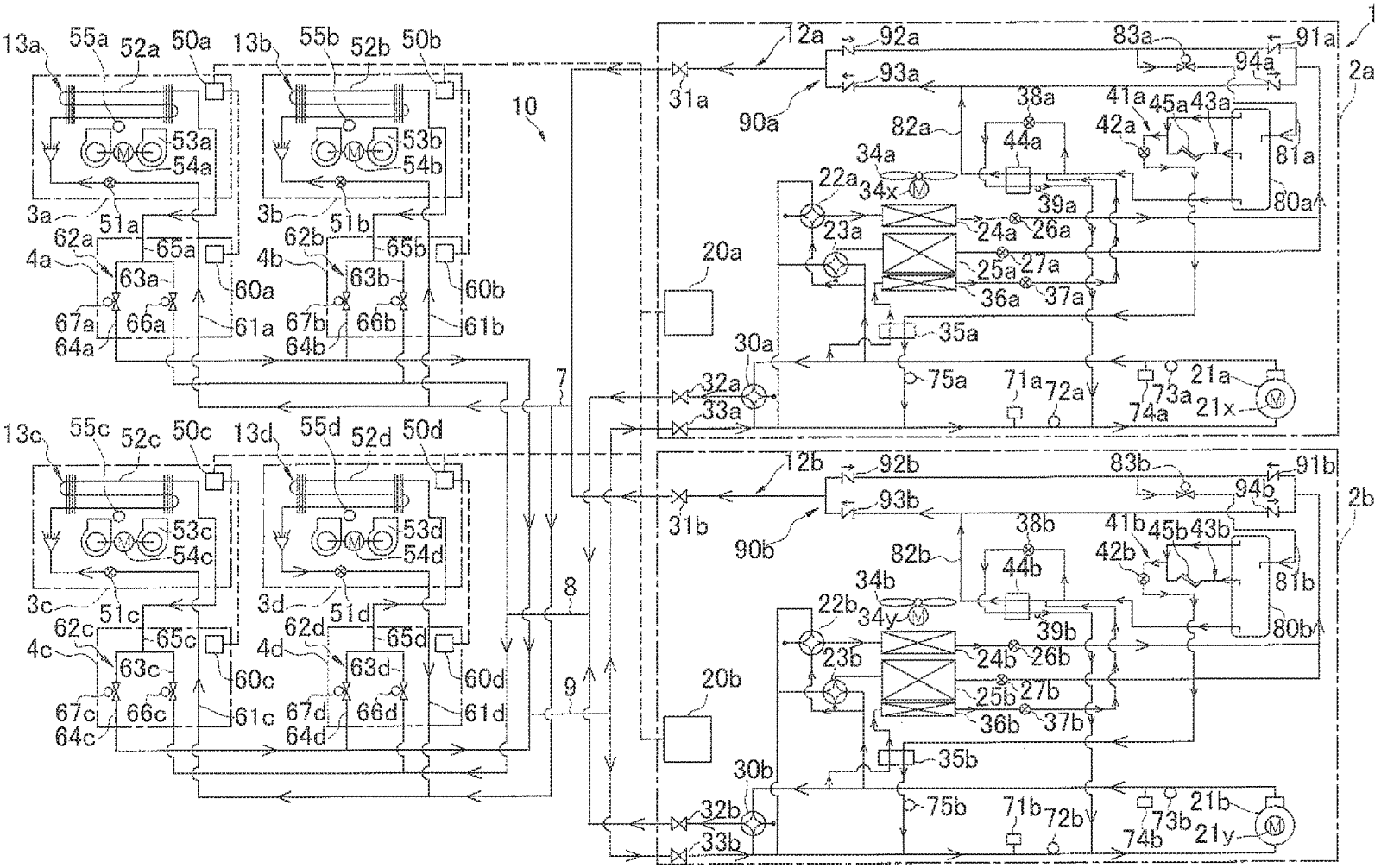
FIG. 5 is a view illustrating operation (refrigerant flow) in simultaneous cooling/heating operation (mainly evaporation load).

During simultaneous cooling/heating operation (mainly evaporation load) e.g., when the usage units 3*a*, 3*b*, 3*c* are performing air-cooling operation and the usage unit 3*d* is performing air-heating operation (i.e., operation in which the usage-side heat exchangers 52*a*, 52*b*, 52*c* function as refrigerant evaporators and the usage-side heat exchanger 52*d* functions as a refrigerant condenser), when the first sub-heat-source-side heat exchangers 24*a* and the second sub-heat-source-side heat exchangers 24h function as refrigerant condensers, the refrigerant circuit 10 of the refrigeration apparatus 1 is configured as illustrated in FIG. 5 (the flow of refrigerant being illustrated by arrows drawn in the refrigerant circuit 10 in FIG. 5).

Specifically, in the first heat-source unit 2*a* (the same in the second heat-source unit 2*b*), the first sub-heat-exchange switching mechanisms 22*a* are switched to the condensing operation state (indicated by solid lines in the first sub-heat-exchange switching mechanisms 22*a* in FIG. 5), whereby only the first sub-heat-source-side heat exchangers 24*a* are caused to function as refrigerant condensers. The first high/low-pressure switching mechanism 30*a* is switched to a mainly-condensation-load operation state (a state indicated by broken lines in the first high/low-pressure switching mechanism 30*a* in FIG. 5). The opening degree of the first-sub-heat-source-side flow rate regulating valve 26*a* is also regulated, the first main heat-source-side flow rate regulating valve 27*a* is closed, and the first receiver inlet opening/closing valve 83*a* is open. Furthermore, the opening degree of the first auxiliary expansion valve 37*a* is regulated, and it is thereby possible to regulate the flow rate of refrigerant in the first auxiliary heat-source-side heat exchanger 36*a*. The opening degree of the first venting-side flow rate regulating valve 42*a* as the first venting-side flow rate regulating mechanism is regulated so as to suppress the intake of wet refrigerant into the first compressor 21*a* on the basis of a value detected by the first venting-side temperature sensor 75*a*, and it is thereby possible to regulate the amount of heat exchange in the first double-tube heat exchanger 35*a*, and the amount of gas refrigerant extracted through the first receiver venting tube 41*a* from the first receiver 80*a* to the intake side of the first compressor 21*a* is regulated. The opening degree of the first subcooling expansion valve 38*a* is also regulated on the basis of the temperature detected by the first subcooling sensor 39*a*, and it is thereby possible to regulate the degree of subcooling of refrigerant flowing through an outlet of the first subcooling heat exchanger 44*a* of the first receiver outlet tube 82*a*. The flow of refrigerant is the same as described above in the second heat-source unit 2*b* as well. In the connecting units 4*a*, 4*b*, 4*c*, 4*d*, the high-pressure-gas opening/closing valve 66*d* and the low-pressure-gas opening/closing valves 67*a*, 67*b*, 67*c* are placed in the open state and the high-pressure-gas opening/closing valves 66*a*, 66*b*, 66*c* and the low-pressure-gas opening/closing valve 67*d* are placed in the closed state, whereby the usage-side heat exchangers 52*a*, 52*b*, 52*c* of the usage units 3*a*, 3*b*, 3*c* are caused to function as refrigerant evaporators, the usage-side heat exchanger 52*d* of the usage unit 3*d* is caused to function as a refrigerant condenser, the usage-side heat exchangers 52*a*, 52*b*, 52*c* of the usage units 3*a*, 3*b*, 3*c* and the intake side of the first compressor 21*a* of the first heat-source unit 2*a* and the intake side of the second compressor 21*b* of the second heat-source unit 2*b* are connected via the low-pressure gas refrigerant communicating tube 9, and the usage-side heat exchanger 52*d* of the usage unit 3*d* and the discharge side of the first compressor 21*a* of the first heat-source unit 2*a* and the discharge side of the second compressor 21*b* of the second heat-source unit 2*b* are connected via the high/low-pressure gas refrigerant communicating tube 8. In the usage units 3*a*, 3*b*, 3*c*, the opening degrees of the usage-side flow rate regulating valves 51*a*, 51*b*, 51*c* are regulated by the first heat-source-side controller 20*a* and the second heat-source-side controller 20*b* so that the degree of superheat of the refrigerant flowing through the outlets of the usage-side heat exchangers 52*a*, 52*b*, 52*c* is at a predetermined value, for example. In the usage unit 3*d*, the opening degree of the usage-side flow rate regulating valve 51*d* is regulated by the first heat-source-side controller 20*a* and the second heat-source-side controller 20*b* so that the degree of subcooling of the refrigerant flowing through the outlet of the usage-side heat exchanger 52*d* is at a predetermined value, for example.

In the refrigerant circuit 10 thus configured, a portion of the high-pressure gas refrigerant compressed and discharged by the first compressor 211*a* is sent to the high/low-pressure gas refrigerant communicating tube 8 through the first high/low-pressure switching mechanism 30*a* and the first high/low-pressure-gas-side shutoff valve 32*a*, another portion of the refrigerant is sent to the first sub-heat-source-side heat exchangers 24*a* through the first sub-heat-exchange switching mechanisms 22*a*, and the remaining refrigerant is sent to the first auxiliary heat-source-side heat exchanger 36*a* through the first double-tube heat exchanger 35*a*, In the same manner, a portion of the high-pressure gas refrigerant compressed and discharged by the second compressor 21*b* is sent to the high/low-pressure gas refrigerant communicating tube 8 through the second high/low-pressure switching mechanism 30*b* and the second high/low-pressure-gas-side shutoff valve 32*b* and merged with the refrigerant from the first heat-source unit 2*a*, another portion of the refrigerant is sent to the second sub-heat-source-side heat exchangers 24*b* through the second sub-heat-exchange switching mechanisms 22*b*, and the remaining refrigerant is sent to the second auxiliary heat-source-side heat exchanger 36*b* through the second double-tube heat exchanger 35*b*.

The high-pressure gas refrigerant merged in the high/low-pressure gas refrigerant communicating tube 8 is then sent to the high-pressure gas connecting tube 63*d* of the connecting unit 4*d*. The high-pressure gas refrigerant sent to the high-pressure gas connecting tube 63*d* is sent to the usage-side heat exchanger 52*d* of the usage unit 3*d* through the high-pressure gas opening/closing valve 66*d* and the merging gas connecting tube 65*d*.

The high-pressure gas refrigerant sent to the usage-side heat exchanger 52*d* is then condensed in the usage-side heat exchanger 52*d* by heat exchange with indoor air supplied by the indoor fan 53*d*. Meanwhile, the indoor air is heated and supplied indoors, and air-heating operation by the usage unit 3*d* is performed. After the flow rate of the refrigerant condensed in the usage-side heat exchanger 52*d* is regulated in the usage-side flow rate regulating valve 51*d*, the refrigerant is sent to the liquid connecting tube 61*d* of the connecting unit 4*d*.

The high-pressure gas refrigerant sent to the first sub-heat-source-side heat exchangers 24*a* is then condensed in the first sub-heat-source-side heat exchangers 24*a* by heat exchange with outdoor air supplied as a heat source by the first outdoor fan 34*a*. After the flow rate of the refrigerant condensed in the first sub-heat-source-side heat exchangers 24*a* is regulated in the first sub-heat-source-side flow rate regulating valve 26*a*, the refrigerant is sent to the first receiver 80*a* through the inlet check valve 91*a* and the first receiver inlet opening/closing valve 83*a*. The refrigerant sent to the first receiver 80*a* is temporarily accumulated in the first receiver 80*a* and separated into gas and liquid, the gas refrigerant passes through the first receiver venting tube 41*a* and is heat-exchanged in the first double-tube heat exchanger 35*a*, and is then extracted to the intake side of the first compressor 21*a*, and the liquid refrigerant is passed through the first receiver outlet tube 82*a* and sent to the liquid refrigerant communicating tube 7 through the outlet check valve 93*a* and the first liquid-side shutoff valve 31*a*. The refrigerant condensed in the first double-tube heat exchanger 35*a* and the first auxiliary heat-source-side heat exchanger 36*a* merges in an intermediate location along the first receiver outlet tube 82*a*.

The refrigerant condensed in the usage-side heat exchanger 52*d* and sent to the liquid connecting tube 61*d* is sent to the liquid refrigerant communicating tube 7 and merged with the refrigerant which is condensed in the first sub-heat-source-side heat exchangers 24*a* and sent to the liquid refrigerant communicating tube 7, and with the refrigerant which is condensed in the second sub-heat-source-side heat exchangers 24*b* and sent to the liquid refrigerant communicating tube 7.

The refrigerant merged in the liquid refrigerant communicating tube 7 is then branched into three streams and sent to the liquid connecting tubes 61*a*, 61*b*, 61*c* of the connecting units 4*a*, 4*b*, 4*c*. The refrigerant sent to the liquid connecting tubes 61*a*, 61*b*, 61*c* is then sent to the usage-side flow rate regulating valves 51*a*, 51*b*, 51*c* of the usage units 3*a*, 3*b*, 3*c*.

After the flow rate of the refrigerant sent to the usage-side flow rate regulating valves 51*a*, 51*b*, 51*c* is regulated in the usage-side flow rate regulating valves 51*a*, 51*b*, 51*c*, the refrigerant is evaporated in the usage-side heat exchangers 52*a*, 52*b*, 52*c* by heat exchange with indoor air supplied by the indoor fans 53*a*, 53*b*, 53*c*, and becomes low-pressure gas refrigerant. Meanwhile, the indoor air is cooled and supplied indoors, and air-cooling operation by the usage units 3*a*, 3*b*, 3*c* is performed. The low-pressure gas refrigerant is then sent to the merging gas connecting tubes 65*a*, 65*b*, 65*c* of the connecting units 4*a*, 4*b*, 4*c*.

The low-pressure gas refrigerant sent to the merging gas connecting tubes 65*a*, 65*b*, 65*c* is then sent to the low-pressure gas refrigerant communicating tube 9 through the low-pressure gas opening/closing valves 67*a*, 67*b*, 67*c* and the low-pressure gas connecting tubes 64*a*, 64*b*, 64*c* and merged.

The low-pressure gas refrigerant sent to the low-pressure gas refrigerant communicating tube 9 is then branched so as to flow to the first heat-source unit 2*a* and the second heat-source unit 2*b*. In the first heat-source unit 2*a*, the refrigerant is then returned to the intake side of the first compressor 21*a* through the first low-pressure-gas-side shutoff valve 33*a*, and, in the second heat-source unit 2*b*, the refrigerant is returned to the intake side of the second compressor 21*b* through the second low-pressure-gas-side shutoff valve 33*b*.

Simultaneous cooling/heating operation (mainly evaporation load) is performed in the manner described above.

In simultaneous cooling/heating operation (mainly evaporation load), in the first compressor 21*a* and the second compressor 21*b*, a target evaporation temperature is set on that the air cooling load in all of the usage-side heat exchangers 52*a*, 52*b*, 52*c* functioning as refrigerant evaporators can be processed, a target condensation temperature is set so that the air heating load in the usage-side heat exchanger 52*d* functioning as a refrigerant condenser can be processed, and the frequency of the first compressor 21*a* and the second compressor 21*b* is controlled so that both the target evaporation temperature and the target condensation temperature can be realized.

When the overall evaporation load of the usage-side heat exchangers 52*a*, 52*b*, 52*c*, 52*d* is reduced due to such factors as a decrease in the number of usage units performing air-cooling operation (i.e., the number of usage-side heat exchangers functioning as refrigerant evaporators), operation is performed whereby the first main heat-source-side heat exchanger 25*a* and the second main heat-source-side heat exchanger 25*b* are caused to function as refrigerant evaporators, whereby the condensation load of the second sub-heat-source-side heat exchangers 24*b* and the evaporation load of the second main heat-source-side heat exchanger 25*b* are canceled out and the overall condensation load of the second sub-heat-source-side heat exchangers 24*b* and the second main heat-source-side heat exchanger 25*b* is reduced, while the condensation load of the first sub-heat-source-side heat exchangers 24*a* and the evaporation load of the first main heat-source-side heat exchanger 25*a* are canceled out and the overall condensation load of the first sub-heat-source-side heat exchangers 24*a* and the first main heat-source-side heat exchanger 25*a* is reduced.

(2-4) Simultaneous Cooling/Heating Operation (Mainly Condensation Load)

Figure 6:
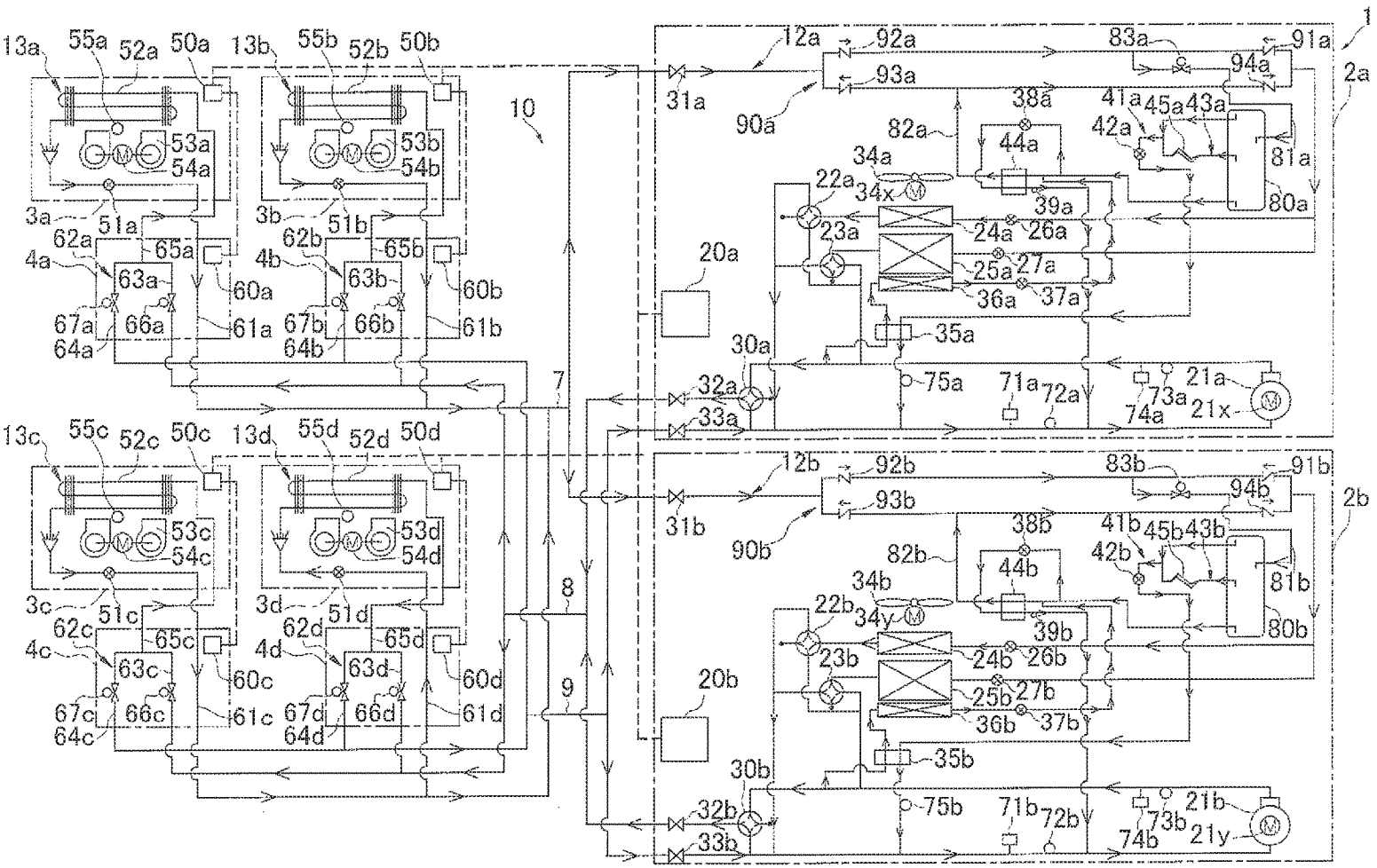
FIG. 6 is a view illustrating operation (refrigerant flow) in simultaneous cooling/heating operation (mainly condensation load).

During simultaneous cooling/heating operation (mainly condensation load) e.g., when the usage units 3*a*, 3*b*, 3*c* are performing air-heating operation and the usage unit 3*d* is performing air-cooling operation (i.e., operation in which the usage-side heat exchangers 52*a*, 52*b*, 52*c* function as refrigerant condensers and the usage-side heat exchanger 52*d* functions as a refrigerant evaporator), when only the first sub-heat-source-side heat exchangers 24*a* and the second sub-heat-source-side heat exchangers 24*b* function as refrigerant evaporators, the refrigerant circuit 10 of the refrigeration apparatus 1 is configured as illustrated in FIG. 6 (See: arrows drawn in the refrigerant circuit 10 in FIG. 6 the flow of refrigerant).

Specifically, in the first heat-source unit 2*a* (the same in the second heat-source unit 2*b*), the first sub-heat-exchange switching mechanisms 22*a* are switched to the evaporating operation state (state indicated by broken lines in the first sub-heat-exchange switching mechanisms 22*a* in FIG. 6), whereby only the first sub-heat-source-side heat exchangers 24*a* are caused to function as refrigerant evaporators. The first high/low-pressure switching mechanism 30*a* is also switched to a mainly-condensation-load operation state (state indicated by broken lines in the first high/low-pressure switching mechanism 30*a* in FIG. 6). The opening degree of the first-sub-heat-source-side flow rate regulating valve 26*a* is also regulated, the first main heat-source-side flow rate regulating valve 27*a* is closed, and the first receiver inlet opening/closing valve 83*a* is open. Furthermore, the opening degree of the first auxiliary expansion valve 37*a* is regulated, and it is thereby possible to regulate the flow rate of refrigerant in the first auxiliary heat-source-side heat exchanger 36*a*. The opening degree of the first venting-side flow rate regulating valve 42*a* as a venting-side flow rate regulating mechanism is regulated so as to suppress the intake of wet refrigerant into the first compressor 21*a* on the basis of a value detected by the first venting-side temperature sensor 75*a*, and it is thereby possible to regulate the amount of heat exchange in the first double-tube heat exchanger 35*a*, and the amount of refrigerant extracted through the first receiver venting tube 41*a* from the first receiver 80*a* to the intake side of the first compressor 21*a* is regulated. The opening degree of the first subcooling expansion valve 38*a* is also regulated on the basis of the temperature detected by the first subcooling sensor 39*a*, and it is thereby possible to regulate the degree of subcooling of refrigerant flowing through the outlet of the first subcooling heat exchanger 44*a* of the first receiver outlet tube 82*a*. The flow of refrigerant as described above is the same in the second heat-source unit 2*b* as well. In the connecting units 4*a*, 4*b*, 4*c*, 4*d*, the high-pressure-gas opening/closing valves 66*a*, 66*b*, 66*c* and the low-pressure-gas opening/closing, valve 67*d* are placed in the open state and the high-pressure-gas opening/closing valve 66*d* and the low-pressure-gas opening/closing valves 67*a*, 67*b*, 67*c* are placed in the closed state, whereby the usage-side heat exchangers 52*a*, 52*b*, 52*c* of the usage units 3*a*, 3*b*, 3*c* are caused to function as refrigerant condensers and the usage-side heat exchanger 52*d* of the usage unit 3*d* is caused to function as a refrigerant evaporator, the usage-side heat exchanger 52*d* of the usage unit 3*d* and the intake side of the first compressor 21*a* of the first heat-source unit 2*a* and the intake side of the second compressor 21*b* of the second heat-source unit 2*b* are connected via the low-pressure gas refrigerant communicating tube 9, and the usage-side heat exchangers 52*a*, 52*b*, 52*c* of the usage units 3*a*, 3*b*, 3*c* and the discharge side of the first compressor 21*a* of the first heat-source unit 2*a* and the discharge side of the second compressor 21*b* of the second heat-source unit 2*b* are connected via the high/low-pressure gas refrigerant communicating tube 8. In the usage units 3*a*, 3*b*, 3*c*, the opening degrees of the usage-side flow rate regulating valves 51*a*, 51*b*, 51*c* are regulated by the first heat-source-side controller 20*a* and the second heat-source-side controller 20*b* so that the degree of subcooling of the refrigerant flowing through the outlets of the usage-side heat exchangers 52*a*, 52*b*, 52*c* is at a predetermined value, for example. In the usage unit 3*d*, the opening degree of the usage-side flow rate regulating valve 51*d* is regulated by the first heat-source-side controller 20*a* and the second heat-source-side controller 20*b* so that the degree of superheat of the refrigerant flowing through the outlet of the usage-side heat exchanger 52*d* is at a predetermined value, for example.

In the refrigerant circuit 10 thus configured, a portion of the high-pressure gas refrigerant compressed and discharged by the first compressor 21*a* is sent to the high/low-pressure gas refrigerant communicating tube 8 through the first high/low-pressure switching mechanism 30*a* and the first high/low-pressure-gas-side shutoff valve 32*a*, and another portion of the refrigerant is sent to the first auxiliary heat-source-side heat exchanger 36*a* through the first double-tube heat exchanger 35*a*. In the same manner, a portion of the high-pressure gas refrigerant compressed and discharged by the second compressor 21*b* is sent to the high/low pressure gas refrigerant communicating tube 8 through the second high/low-pressure switching mechanism 30*b* and the second high/low-pressure-gas-side shutoff valve 32*b*, and another portion of the refrigerant is sent to the high/low-pressure gas refrigerant communicating tube 8 through the second double-tube heat exchanger 35*b* and the second auxiliary heat-source-side heat exchanger 36*b*, and merged.

The high-pressure gas refrigerant sent to the high/low-pressure gas refrigerant communicating tube 8 is then branched into three streams and sent to the high-pressure gas connecting tubes 63*a*, 63*b*, 63*c* of the connecting units 4*a*, 4*b*, 4*c*. The high-pressure gas refrigerant sent to the high-pressure gas connecting tubes 63*a*, 63*b*, 63*c* is sent to the usage-side heat exchangers 52*a*, 52*b*, 52*c* of the usage units 3*a*, 3*b*, 3*c* through the high-pressure gas opening/closing valves 66*a*, 66*b*, 66*c* and the merging gas connecting tubes 65*a*, 65*b*, 65*c*.

The high-pressure gas refrigerant sent to the usage-side heat exchangers 52*a*, 52*b*, 52*c* is then condensed in the usage-side heat exchangers 52*a*, 52*b*, 52*c* by heat exchange with indoor air supplied by the indoor fans 53*a*, 53*b*, 53*c*. Meanwhile, the indoor air is heated and supplied indoors, and air-heating operation by the usage units 3*a*, 3*b*, 3*c* is performed. After the flow rate of the refrigerant condensed in the usage-side heat exchangers 52*a*, 52*b*, 52*c* is regulated in the usage-side flow rate regulating valves 51*a*, 51*b*, 51*c*, the refrigerant is sent to the liquid connecting tubes 61*a*, 61*b*, 61*c* of the connecting units 4*a*, 4*b*, 4*c*.

The refrigerant sent to the liquid connecting tubes 61*a*, 61*b*, 61*c*, 61*d* is then sent to the liquid refrigerant communicating tube 7 and merged.

A portion of the refrigerant merged in the liquid refrigerant communicating tube 7 is sent to the liquid connecting tube 61*d* of the connecting unit 4*d*, and the remainder of the refrigerant is branched so as to flow to the first heat-source unit 2*a* and the second heat-source unit 2*b*. In the first heat-source unit 2*a*, the refrigerant is then sent to the first receiver 80*a* through the first liquid-side shutoff valve 31*a*, the inlet check valve 92*a*, and the first receiver inlet opening/closing valve 83*a*, and, in the second heat-source unit 2*b*, the refrigerant is sent to the second receiver 80*b* through the second liquid-side shutoff valve 31*b*, the inlet check valve 92*b*, and the second receiver inlet opening/closing valve 83*b*.

The refrigerant sent to the liquid connecting tube 61*d* of the connecting unit 4*d* is then sent to the usage-side flow rate regulating valve 51*d* of the usage unit 3*d*.

After the flow rate of the refrigerant sent to the usage-side flow rate regulating valve 51*d* is regulated in the usage-side flow rate regulating valve 51*d*, the refrigerant is evaporated in the usage-side heat exchanger 52*d* by heat exchange with indoor air supplied by the indoor fan 53*d*, and becomes low-pressure gas refrigerant. Meanwhile, the indoor air is cooled and supplied indoors, and air-cooling operation by the usage unit 3*d* is performed. The low-pressure gas refrigerant is then sent to the merging gas connecting tube 65*d* of the connecting unit 4*d*.

The low-pressure gas refrigerant sent to the merging gas connecting tube 65*d* is then sent to the low-pressure gas refrigerant communicating tube 9 through the low-pressure gas opening/closing valve 67*d* and the low-pressure gas connecting tube 64*d*.

The low-pressure gas refrigerant sent to the low-pressure gas refrigerant communicating tube 9 is then branched so as to flow to the first heat-source unit 2*a* and the second heat-source unit 2*b*. In the first heat-source unit 2*a*, the refrigerant is then returned to the intake side of the first compressor 21*a* through the first low-pressure-gas-side shutoff valve 33*a*, and, in the second heat-source unit 2*b*, the refrigerant is returned to the intake side of the second compressor 21*b* through the second low-pressure-gas-side shutoff valve 33*b*.

The refrigerant sent to the first receiver 80*a* is temporarily accumulated in the first receiver 80*a* and separated into gas and liquid, the gas refrigerant passes through the first receiver venting tube 41*a* and is heat-exchanged in the first double-tube heat exchanger 35*a*, and is then extracted to the intake side of the first compressor 21*a*, and the liquid refrigerant passes through the first receiver outlet tube 82*a* and is sent to the first sub-heat-source-side flow rate regulating valve 26*a* through the outlet check valve 94*a*. The refrigerant condensed in the first double-tube heat exchanger 35*a* and the first auxiliary heat-source-side heat exchanger 36*a* merges in an intermediate location along the first receiver outlet tube 82*a*. After the flow rate of the refrigerant sent to the first sub-heat-source-side flow rate regulating valve 26*a* is regulated in the first sub-heat-source-side flow rate regulating valve 26*a*, the refrigerant is evaporated in the first sub-heat-source-side heat exchangers 24*a* by heat exchange with outdoor air supplied by the first outdoor fan 34*a*, becomes low-pressure gas refrigerant and is sent to the first sub-heat-exchange switching mechanisms 22*a*. The low-pressure gas refrigerant sent to the first sub-heat-exchange switching mechanisms 22*a* merges with the low-pressure gas refrigerant returned to the intake side of the first compressor 21*a* through the first low-pressure-gas-side shutoff valve 33*a*, which is the portion of refrigerant branched after passing through the low-pressure gas refrigerant communicating tube 9, and is returned to the intake side of the first compressor 21*a*. The refrigerant sent to the second receiver 80*b* also flows in the same manner, and is sent to the second sub-heat-exchange switching mechanisms 22*b*. The low-pressure gas refrigerant sent to the second sub-heat-exchange switching mechanisms 22*b* merges with the low-pressure gas refrigerant returned to the intake side of the second compressor 21*b* through the second low-pressure-gas-side shutoff valve 33*b*, which is the other portion of refrigerant branched after passing through the low-pressure gas refrigerant communicating tube 9, and is returned to the intake side of the second compressor 21*b*.

The simultaneous cooling/heating operation (mainly condensation load) is performed in the manner described above.

In simultaneous cooling/heating operation (mainly condensation load), in the first compressor 21*a* and the second compressor 21*b*, a target condensation temperature is set on that the air heating load in all of the usage-side heat exchangers 52*a*, 52*b*, 52*c* functioning as refrigerant condensers can be processed, a target evaporation temperature is set so that the air cooling load in the usage-side heat exchanger 52*d* functioning as a refrigerant evaporator can be processed, and the frequency of the first compressor 21*a* and the second compressor 21*b* is controlled so that both the target condensation temperature and the target evaporation temperature can be realized.

When the overall condensation load of the usage-side heat exchangers 52*a*, 52*b*, 52*d* is reduced due to such factors as a decrease in the number of usage units performing air-heating operation (i.e., usage-side heat exchangers functioning as refrigerant condensers), operation is performed whereby the first main heat-source-side heat exchanger 25*a* is caused to function as a refrigerant condenser, whereby the evaporation load of the second sub-heat-source-side heat exchangers 24*b* and the condensation load of the second main heat-source-side heat exchanger 25*b* are canceled out and the overall condensation load of the second sub-heat-source-side heat exchangers 24*b* and the second main heat-source-side heat exchanger 25*b* is reduced, while the evaporation load of the first sub-heat-source-side heat exchangers 24*a* and the condensation load of the first main heat-source-side heat exchanger 25*a* are canceled out and the overall evaporation load of the first main heat-source-side heat exchanger 25*a* is reduced.

(3) Liquid Level Detecting in First Receiver 80*a* and Second Receiver 80*b*

Figure 7:
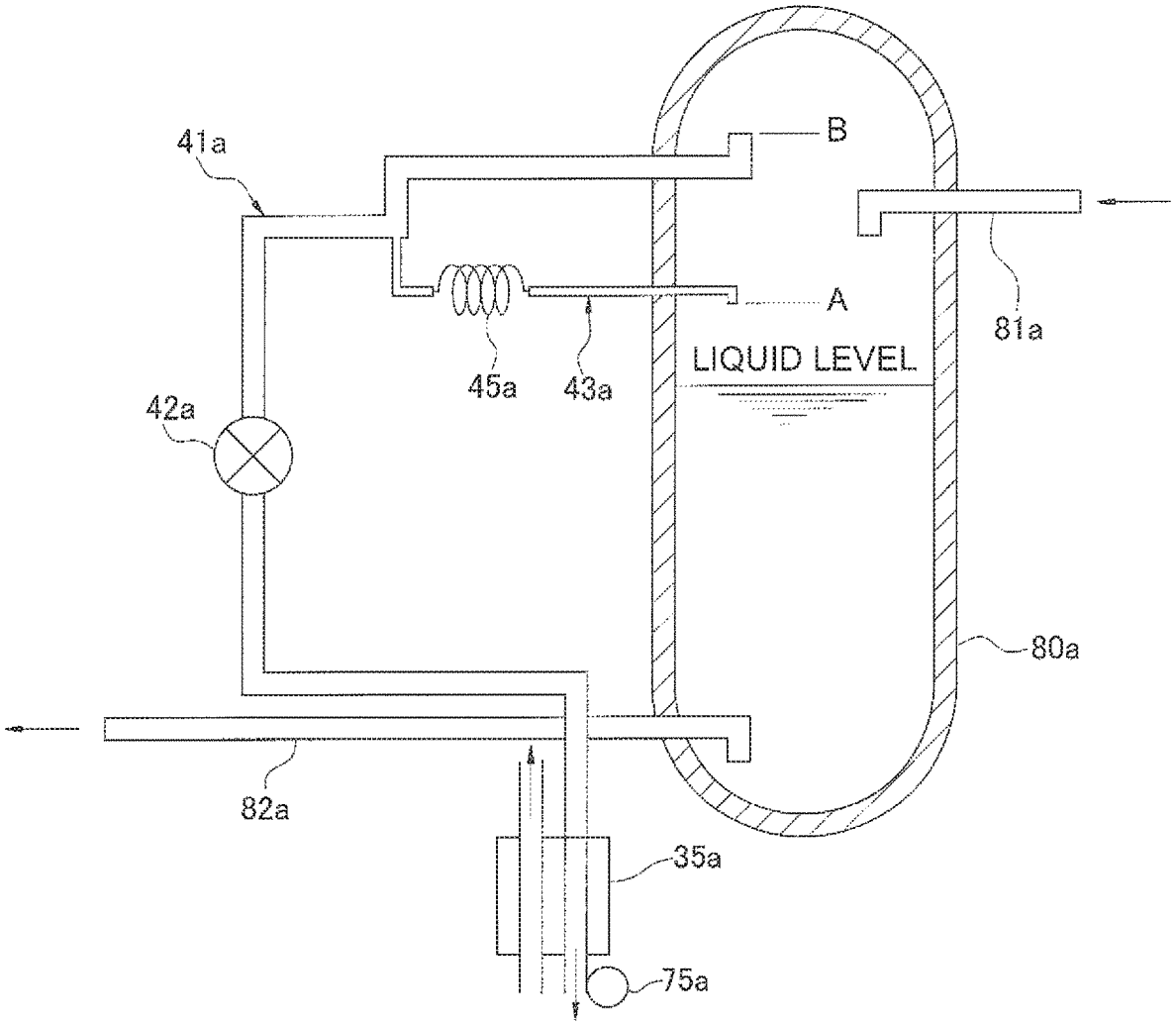
FIG. 7 is a schematic configuration diagram of the first receiver and the periphery thereof.

The description given below with reference to the schematic configuration diagram in FIG. 7 uses the first receiver 80 as an example, but the second receiver 80*b* is configured in the same manner.

In the various refrigerating cycle operations described above, an operation is performed for extracting refrigerant from the first receiver 80*a* to the intake side of the first compressor 21*a* through the first receiver venting tube 41*a*. The first receiver venting tube 41*a* is provided so as to extract refrigerant from the top part in the first receiver 80*a*, and therefore normally extracts only the gas refrigerant separated into gas and liquid in the first receiver 80*a* from the first receiver 80*a*.

However, when the amount of liquid refrigerant accumulated in the first receiver 80*a* is extremely large, due to such factors as a large amount of excess refrigerant occurring in the refrigerant circuit 10, the first receiver 80*a* may sometimes be nearly flooded (height position B in this case). A state in which the ratio of the inside of the receiver that is occupied by liquid refrigerant is thus high, as in a state in which the height position B is reached merely by the liquid-phase refrigerant among gas-liquid two-phase refrigerant and/or liquid-phase refrigerant inside the first receiver 80*a*, is referred to as a flooded state. In such a flooded state, there is a risk of liquid refrigerant returning from the first receiver 80*a* to the intake side of the first compressor 21*a* through the first receiver venting tube 41*a*.

A configuration is therefore adopted in which the first receiver 80*a* is provided with a receiver liquid level detecting tube 43*a* for detecting whether the liquid level in the first receiver 80*a* has reached a predetermined position (height position A below the height position B in this configuration) below the position (height position B in this configuration) at which the first receiver venting tube 41*a* is connected.

The liquid level in the first receiver 80*a* is detected by the first receiver liquid level detecting tube 43*a* as described below.

First, the first receiver liquid level detecting tube 43*a* extracts refrigerant from the predetermined height position A of the first receiver 80*a* during the various refrigerating cycle operations described above. Here, the refrigerant extracted from the first receiver liquid level detecting tube 43*a* is in a gas state when the liquid level in the first receiver 80*a* is lower than the predetermined height position A, and is in a liquid state when the liquid level in the first receiver 80*a* is at or above the predetermined height position A.

The refrigerant extracted from the receiver liquid level detecting tube 43*a* then merges with the refrigerant extracted from the first receiver venting tube 41*a*. Here, the refrigerant extracted from the first receiver venting tube 41*a* is in the gas state when the liquid level in the first receiver 80*a* is lower than the predetermined height position B. Therefore, when the refrigerant extracted from the first receiver liquid level detecting tube 43*a* is in the gas state, after merging thereof with the refrigerant extracted from the first receiver venting tube 41*a*, the refrigerant flowing through the first receiver venting tube 41*a* is also in the gas state. Meanwhile, when the refrigerant extracted from the first receiver liquid level detecting tube 43*a* is in the liquid state, after merging thereof with the refrigerant extracted from the first receiver venting tube 41*a*, the refrigerant flowing through the first receiver venting tube 41*a* is in a gas-liquid two-phase state in which liquid refrigerant is mixed with gas refrigerant. The refrigerant flowing through the first receiver venting tube 41*a* after merging of the refrigerant extracted from the first receiver liquid level detecting tube 43*a* therewith is then de-pressurized nearly to a pressure of the refrigerant on the intake side of the first compressor 21*a* by the first venting-side flow rate regulating valve 42*a*. This depressurization process by the first venting-side flow rate regulating valve 42*a* causes the refrigerant flowing through the first receiver venting tube 41*a* to decrease in temperature by an amount corresponding to the state of the refrigerant prior to the depressurization process. Specifically, the temperature decrease due to the depressurization process is small when the refrigerant flowing through the first receiver venting tube 41*a* is in the gas state, and the temperature decrease due to the depressurization process is large when the refrigerant flowing through the first receiver venting tube 41*a* is in the gas-liquid two-phase state. Therefore, although this configuration is not employed herein, it is possible to detect whether the refrigerant extracted from the first receiver liquid level detecting tube 43*a* is in the liquid state (whether the liquid level in the first receiver 80*a* has reached the height position A) using the temperature of the refrigerant flowing through the first receiver venting tube 41*a* after the depressurization process by the first venting-side flow rate regulating valve 42*a*.

The refrigerant flowing through the first receiver venting tube 41*a* after the depressurization process by the first venting-side flow rate regulating valve 42*a* is then sent to the first double-tube heat exchanger 35*a*, and is heated by heat exchange with the refrigerant discharged from the first compressor 21*a* and flowing toward the first auxiliary heat-source-side heat exchanger 36*a*. This heating process by the first double-tube heat exchanger 35*a* causes the refrigerant flowing through the first receiver venting tube 41*a* to increase in temperature by an amount corresponding to the state of the refrigerant prior to the heating process. Specifically, the temperature increase due to the heating process is large when the refrigerant flowing through the first receiver venting tube 41*a* after the depressurization process by the first venting-side flow rate regulating valve 42*a* is in the gas state, and the temperature increase due to the heating process is small when the refrigerant flowing through the first receiver venting tube 41*a* is in the gas-liquid two-phase state. Therefore, in this configuration, the first venting-side temperature sensor 75*a* detects the temperature of the refrigerant flowing through the first receiver venting tube 41*a* after the heating process by the first double-tube heat exchanger 35*a*, and it is possible to detect whether the refrigerant extracted from the first receiver liquid level detecting tube 43*a* is in the liquid state (whether the liquid level in the first receiver 80*a* has reached the height position A: whether the first receiver 80*a* is approaching a flooded state) using the detected temperature. Specifically, a saturation temperature of the refrigerant obtained by converting the pressure of the refrigerant detected by the first intake pressure sensor 71*a* is subtracted from the temperature of the refrigerant detected by the first venting-side temperature sensor 75*a*, and the degree of superheat of the refrigerant flowing through the first receiver venting tube 41*a* after the heating process by the first double-tube heat exchanger 35*a* is thereby obtained. When the degree of superheat of the refrigerant is equal to or greater than a predetermined value, a determination is made that the refrigerant extracted from the first receiver liquid level detecting tube 43*a* is in the gas state (liquid level in the first receiver 80*a* has not reached the height position A: the first receiver 80*a* is not approaching a flooded state), and when the degree of superheat of the refrigerant has a value lower than the predetermined value, a determination is made that the refrigerant extracted from the first receiver liquid level detecting tube 43*a* is in the liquid state (liquid level in the first receiver 80*a* has reached the height position A: the first receiver 80*a* is approaching a flooded state).

The liquid level in the first receiver 80*a* can thus be detected using the first receiver liquid level detecting tube 43*a* and the first receiver venting tube 41*a* provided to the first receiver 80*a*.

As described hereinafter, excess refrigerant distribution control is started when it is detected that the refrigerant extracted from the first and second receiver liquid level detecting tubes 43*a*, 43*b* is in the liquid state, but when the degree of superheat of the refrigerant flowing through the first and second receiver venting tubes 41*a*, 41*b* after the end of heat exchange in the first and second double-tube heat exchangers 35*a*, 35*b* vanishes and the refrigerant becomes wet despite the starting of excess refrigerant distribution control, the opening degrees of the first and second venting-side flow rate regulating valves 42*a*, 42*b* are significantly throttled, and sending of liquid refrigerant to the first and second compressors 21*a*, 21*b* is thereby suppressed.

(4) Excess Refrigerant Distribution Control in the First Receiver 80*a* and the Second Receiver 80*b*

In the refrigerant circuit 10, for example, a given amount of refrigerant is enclosed so that a predetermined refrigerating capacity can be demonstrated. However, when there is a large amount of excess liquid refrigerant in the refrigerant circuit 10 due to load variations during operation, liquid refrigerant gradually accumulates in the first receiver 80*a* of the first heat-source unit 2*a* and/or the second receiver 80*b* of the second heat-source unit 2*b*.

In this case, when the gradual accumulation of liquid refrigerant is the same in the first receiver 80*a* of the first heat-source unit 2*a* and in the second receiver 80*b* of the second heat-source unit 2*b*, installing the first receiver 80*a* and the second receiver 80*b* having a volume corresponding to the enclosed refrigerant makes it possible to retain the excess refrigerant by allowing both the first receiver 80*a* and the second receiver 80*b* to approach a flooded state.

Although the first heat-source unit 2*a* and the second heat-source unit 2*b* are connected in parallel with the plurality of usage units 3*a-d* in this configuration, a refrigerant bias sometimes occurs due to the presence of slight differences in the length of refrigerant piping for connecting the plurality of usage units 3*a-d* according to the installation positions of the first heat-source unit 2*a* and the second heat-source unit 2*b*, and/or slight differences in pass-through resistance inside the refrigerant piping. When the refrigerant bias occurs, there is sometimes a disparity between the amount of liquid refrigerant inside the first receiver 80*a* of the first heat-source unit 2*a* and the amount of liquid refrigerant inside the second receiver 80*b* of the second heat-source unit 2*b*. In this case, when liquid refrigerant is retained equally in both the first receiver 80*a* and the second receiver 80*b*, despite a design enabling retention of excess refrigerant, there is a risk of exceeding the flooded state in either receiver when a refrigerant bias occurs. Particularly when the plurality of usage units 3*a-d* are present and the plurality of heat-source units including the first heat-source unit 2*a* and the second heat-source unit 2*b* are present, the refrigerant circuit 10 is filled with too much amount of refrigerant, and the flooded state in either receiver is therefore readily exceeded when the refrigerant bias occurs.

In order to address this problem, the first heat-source-side controller 20*a* and the second heat-source-side controller 20*b* in the present embodiment perform the excess refrigerant distribution control in order to suppress the bias in the amount of liquid refrigerant retained in the first receiver 80*a* and the second receiver 80*b*.

In the excess refrigerant distribution control, the valve opening of the first venting-side flow rate regulating valve 42*a* provided at an intermediate location along the first receiver venting tube 41*a* of the first heat-source unit 2*a* and the valve opening of the second venting-side flow rate regulating valve 42*b* provided at an intermediate location along the second receiver venting tube 41*b* of the second heat-source unit 2*b* are controlled, and the bias in the amount of refrigerant is thereby suppressed.

Figure 8:
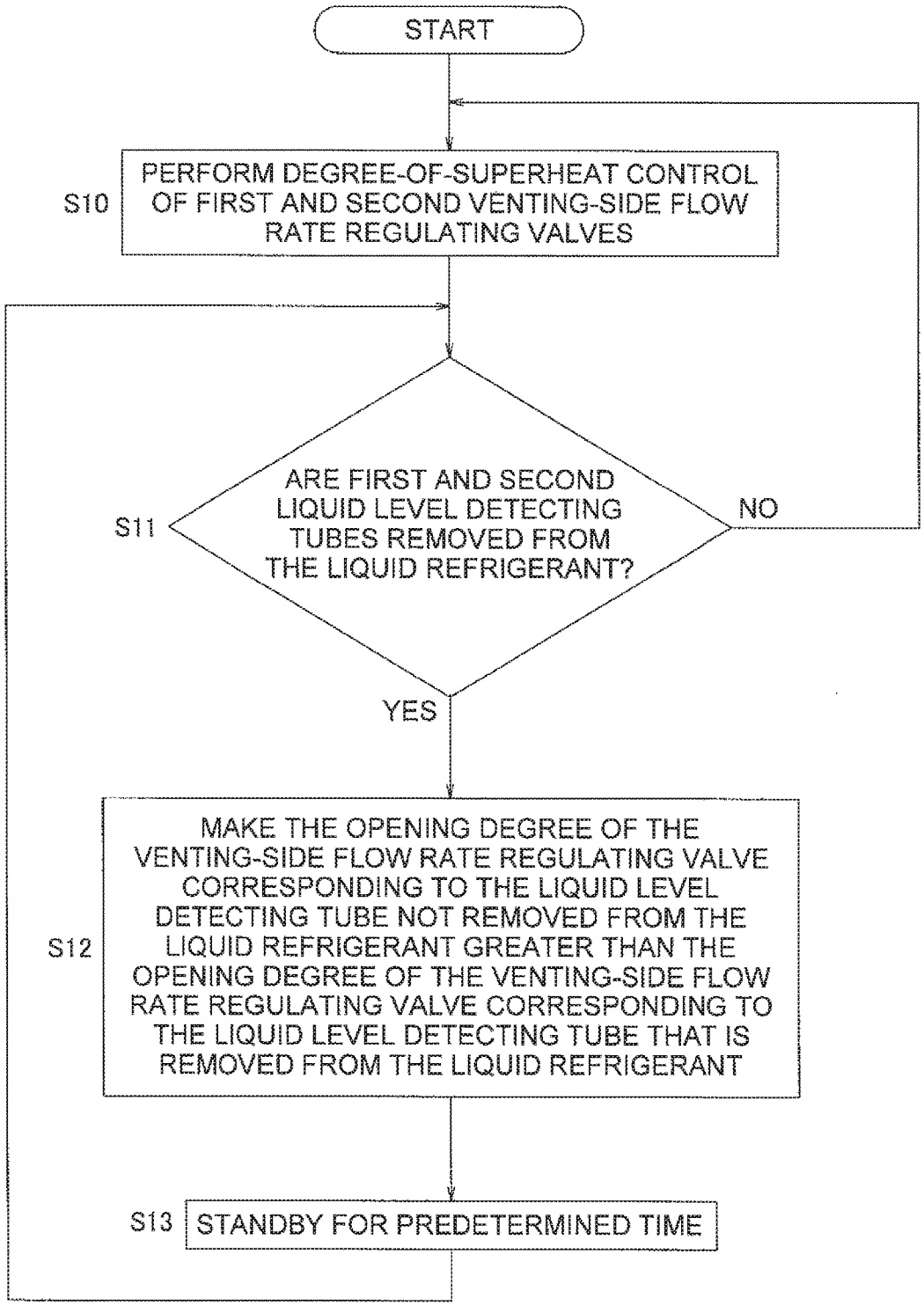
FIG. 8 is a flowchart for explaining excess refrigerant distribution control.

Here, as illustrated in the flowchart in FIG. 8, in a state in which the excess refrigerant distribution control of the first venting-side flow rate regulating valve 42*a* and the second venting-side flow rate regulating valve 42*b* is not performed, the first heat-source-side controller 20*a* and the second heat-source-side controller 20*b* perform degree-of-superheat control for maintaining the degree of superheat on the basis of the temperature detected by the first venting-side temperature sensor 75*a* and the temperature detected by the second venting-side temperature sensor 75*b*, respectively (step S10). Specifically, the first heat-source-side controller 20*a* controls the valve opening of the first venting-side flow rate regulating valve 42*a* on the basis of the temperature detected by the first venting-side temperature sensor 75*a* so that the degree of superheat of the refrigerant after passing through the first double-tube heat exchanger 35*a* of the first receiver venting tube 41*a* is equal to or greater than a predetermined value. The refrigerant drawn into the first compressor 21*a* can thereby be prevented from changing to the liquid state. The second heat-source-side controller 20*b* controls the valve opening of the second venting-side flow rate regulating valve 42*b* on the basis of the temperature detected by the second venting-side temperature sensor 75*b* so that the degree of superheat of the refrigerant after passing through the second double-tube heat exchanger 35*b* of the second receiver venting tube 41*b* is equal to or greater than a predetermined value. The refrigerant drawn into the second compressor 21*b* can thereby be prevented from changing to the liquid state.

In a condition in which degree-of-superheat control of the first venting-side flow rate regulating valve 42*a* and the second venting-side flow rate regulating valve 42*b* is being performed in this manner, when extraction of liquid refrigerant from the first receiver liquid level detecting tube 43*a* is perceived (when the first receiver 80*a* is approaching a flooded state), or extraction of liquid refrigerant from the second receiver liquid level detecting tube 43*b* is perceived (when the second receiver 80*b* is approaching a flooded state), the first heat-source-side controller 20*a* and the second heat-source-side controller 20*b* start the excess refrigerant distribution control ("Yes" in step S11).

When the excess refrigerant distribution control is started, the first heat-source-side controller 20*a* and the second heat-source-side controller 20*b* regulate valve openings so that the valve opening of the venting-side flow rate regulating valve 42*a* or 42*b* of the first receiver liquid level detecting tube 43*a* or the second receiver liquid level detecting tube 43*b* in which extraction of liquid refrigerant is not detected is greater than the valve opening of the venting-side flow rate regulating valve 42*b* or 42*a* corresponding to the first receiver liquid level detecting tube 43*a* or the second receiver liquid level detecting tube 43*b* in which extraction of liquid refrigerant is detected (step S12).

The method for regulating the valve openings during excess refrigerant distribution control is not particularly limited, and control may be performed whereby the valve opening of the venting-side flow rate regulating valve 42*a* or 42*b* of the first receiver liquid level detecting tube 43*a* or the second receiver liquid level detecting tube 43*b* in which extraction of liquid refrigerant is not detected is increased a predetermined opening degree at a time (predetermined incremental pulsing) until greater than the valve opening of the venting-side flow rate regulating valve 42*b* or 42*a* corresponding to the first receiver liquid level detecting tube 43*a* or the second receiver liquid level detecting tube 43*b* in which extraction of liquid refrigerant is detected. Processing whereby, e.g., the valve opening of the venting-side flow rate regulating valve 42*b* or 42*a* of the first receiver liquid level detecting tube 43*a* or the second receiver liquid level detecting tube 43*b* in which extraction of liquid refrigerant is detected is reduced by only a predetermined opening degree while the valve opening of the venting-side flow rate regulating valve 42*a* or 42*b* of the first receiver liquid level detecting tube 43*a* or the second receiver liquid level detecting tube 43*b* in which extraction of liquid refrigerant is not detected is increased by only a predetermined opening degree, may also be repeated until the valve opening of the venting-side flow rate regulating valve 42*a* or 42*b* of the first receiver liquid level detecting tube 43*a* or the second receiver liquid level detecting tube 43*b* in which extraction of liquid refrigerant is not detected is greater than the valve opening of the venting-side flow rate regulating valve 42*b* or 42*a* corresponding to the first receiver liquid level detecting tube 43*a* or the second receiver liquid level detecting tube 43*b* in which extraction of liquid refrigerant is detected.

In the present embodiment, control is performed by the first heat-source-side controller 20*a* and the second heat-source-side controller 20*b* so that the first venting-side flow rate regulating valve 42*a*, the opening degree of which is controlled, does not become completely closed when extraction of liquid refrigerant from the first receiver liquid level detecting tube 43*a* is perceived, and also so that the second venting-side flow rate regulating valve 42*b*, the opening degree of which is controlled, does not become completely closed when extraction of liquid refrigerant from the second receiver liquid level detecting tube 43*b* is perceived.

The method for regulating the valve openings when excess refrigerant distribution control is performed is not particularly limited, but control is preferably performed so that the degree of superheat of the refrigerant in the receiver venting tube 41*a* or 41*b* corresponding to the venting-side flow rate regulating valve 42*a* or 42*b* for which the valve opening is increased, the refrigerant having passed through the double-tube heat exchanger 35*a* or 35*b*, has a value less than the predetermined value of the degree of superheat used as a condition in the degree-of-superheat control described above, and is greater than a pre-set positive value. It is thereby possible to suppress liquid compression in the compressors 21*a*, 21*b* while reducing bias of excess refrigerant.

After the excess refrigerant distribution control is performed as described above, the first heat-source-side controller 20*a* and the second heat-source-side controller 20*b* stand by until a predetermined time has elapsed (step S13), and a determination is again made as to whether extraction of liquid refrigerant from the first receiver liquid level detecting tube 43*a* or extraction of liquid refrigerant from the second receiver liquid level detecting tube 43*b* is occurring. The first heat-source-side controller 20*a* and the second heat-source-side controller 20*b* repeat the processing described above.

(5) Features of Refrigeration Apparatus 1

In the refrigeration apparatus 1, the first heat-source-side controller 20*a* and the second heat-source-side controller 20*b* regulate valve openings so that the valve opening of the venting-side flow rate regulating valve 42*a* or 42*b* of the first receiver liquid level detecting tube 43*a* or the second receiver liquid level detecting tube 43*b* in which extraction of liquid refrigerant is not detected is greater than the valve opening of the venting-side flow rate regulating valve 42*b* or 42*a* corresponding to the first receiver liquid level detecting tube 43*a* or the second receiver liquid level detecting tube 43*b* in which extraction of liquid refrigerant is detected.

The valve opening of the venting-side flow rate regulating valve 42*a* or 42*b* of the first receiver liquid level detecting tube 43*a* or the second receiver liquid level detecting tube 43*b* in which extraction of liquid refrigerant is not detected therefore increases, and it is thereby possible to facilitate extraction of gas refrigerant via the receiver venting tube 41*a* or 41*b* from the receiver 80*a* or 80*b* having a high gas ratio and corresponding to the first receiver liquid level detecting tube 43*a* or the second receiver liquid level detecting tube 43*b* in which extraction of liquid refrigerant is not detected. The ratio of liquid refrigerant in the receiver 80*a* or 80*b* from which gas refrigerant is extracted thereby increases, and as a result, the liquid level in a nearly flooded receiver 80*a* or 80*b* decreases, and the liquid level in the receiver 80*a* or 80*b* having a high gas ratio increases. The above configuration makes it possible to reduce a bias of liquid refrigerant.

In the present embodiment, control is performed by the first heat-source-side controller 20*a* and the second heat-source-side controller 20*b* so that the venting-side flow rate regulating valve 42*a* or 42*b* corresponding to extraction of liquid refrigerant does not become completely closed. Therefore, even in the receiver 80*a* or 80*b* detected to be approaching a flooded state, a condition is maintained in which gas refrigerant can be extracted via the venting-side flow rate regulating valve 42*a* or 42*b* thereof, and it is therefore possible to regulate the ratio of liquid refrigerant and gas refrigerant in the receiver 80*a* or 80*b*. A state is also maintained in which refrigerant flows through the receiver venting tubes 41*a*, 41*b*, and it is therefore possible to avoid a problem that emerges when the venting-side flow rate regulating valves 42*a*, 42*b* completely close (problem being that the degree of superheat of the refrigerant after passing through the first double-tube heat exchanger 35*a* of the first receiver venting tube 41*a* and/or the degree of superheat of the refrigerant after passing through the second double-tube heat exchanger 35*b* of the second receiver venting tube 41*b* cannot be perceived, and it is difficult to measure the timing at which to reopen the venting-side flow rate regulating valves 42*a*, 42*b*).

The refrigerant flowing through the receiver venting tubes 41*a*, 41*b* for leading refrigerant to the intake sides of the compressors 21*a*, 21*b* is heated by heat exchange in the double-tube heat exchangers 35*a*, 35*b* with the refrigerant discharged from the compressors 21*a*, 21*b* and flowing toward the auxiliary heat-source-side heat exchangers 36*a*, 36*b*. The refrigerant discharged from the compressors 21*a*, 21*b* and flowing toward the auxiliary heat-source-side heat exchangers 36*a*, 36*b* is high-temperature, high-pressure refrigerant, and is therefore capable of adequately heating the refrigerant flowing through the receiver venting tubes 41*a*, 41*b*, and it is possible to effectively suppress the intake of liquid refrigerant into the compressors 21*a*, 21*b*.

(6) Other Embodiments

The preceding embodiment has been described as but one example of embodiment of the present invention, but is in no way intended to limit the invention of the present application, which is not limited to the aforedescribed embodiment.

The scope of the invention of the present application would as a matter of course include appropriate modifications that do not depart from the spirit thereof.

(6-1) Other Embodiment A

In the above embodiment, an example is described in which the presence of liquid refrigerant extraction is detected using the first venting-side temperature sensor 75*a* and the first receiver liquid level detecting tube 43*a* and/or the second venting-side temperature sensor 75*b* and the second receiver liquid level detecting tube 43*b* to determine whether the receivers 80*a*, 80*b* are approaching a flooded state.

However, the present invention is not limited to this configuration, and a configuration may be adopted in which the liquid level in the first receiver 80*a* and/or the second receiver 80*b* is detected using a sensor capable of directly detecting the height of a liquid level, such as a float sensor, and a determination is thereby made as to whether the receiver 80*a*, 80*b* is approaching a flooded state, for example.

(6-2) Other Embodiment B

In the above embodiment, an example is described in which the first venting-side flow rate regulating valve 42*a* and the second venting-side flow rate regulating valve 42*b* are subjected to degree-of-superheat control before the excess refrigerant distribution control is started.

However, the present invention is not limited to this configuration, and a configuration may be adopted in which the first venting-side flow rate regulating valve 42*a* and the second venting-side flow rate regulating valve 42*b* are maintained in a fully closed state before the start of excess refrigerant distribution control, and the first receiver venting tube 41*a* and/or the second receiver venting tube 41*b* are thereby in an unused condition.

A configuration may be adopted in this case whereby, in a condition in which a usage-side heat exchanger among the usage-side heat exchangers 52*a-d* is functioning as a refrigerant condenser, when the degree of subcooling of refrigerant flowing through the outlet of the usage-side heat exchanger 52*a-d* is equal to or greater than a predetermined value, the first venting-side flow rate regulating valve 42*a* and/or the second venting-side flow rate regulating valve 42*b* are opened, thereby initiating use of the first receiver venting tube 41*a* and/or the second receiver venting tube 41*b*.

In this case, by suppressing excessive accumulation of liquid refrigerant in the usage-side heat exchangers 52*a-d*, a region in which refrigerant condensation occurs in the usage-side heat exchangers 52*a-d* is readily ensured, and condensing capacity can be increased.

What is claimed is:

1. A refrigeration apparatus comprising:

a refrigerant circuit configured by connecting at least two heat-source units in parallel with usage units, the usage units having a usage-side heat exchanger and a usage-side motor-operated valve, the heat-source units having at least a first heat-source unit and a second heat-source unit, the first heat-source unit having a first compressor, a first heat-source-side heat exchanger, a first high-pressure receiver, a first detecting element arranged and configured to detect a predetermined pre-flooding state of refrigerant in the first high-pressure receiver, a first bypass channel arranged and configured to return refrigerant positioned at a top part in the first high-pressure receiver to an intake side of the first compressor, and a first motor-operated valve provided on the first bypass channel, the second heat-source unit having a second compressor, a second heat-source-side heat exchanger, a second high-pressure receiver, a second detecting element arranged and configured to detect a predetermined pre-flooding state of refrigerant in the second high-pressure receiver, a second bypass channel arranged and configured to return refrigerant positioned at a top part in the second high-pressure receiver to an intake side of the second compressor, and a second motor-operated valve provided on the second bypass channel, and a controller being provided to perform excess refrigerant distribution control in which an opening degree of the first motor-operated valve is controlled so as to be greater than an opening degree of the second motor-operated valve when the second detecting element detects the predetermined pre-flooding state of refrigerant in the second high-pressure receiver, and the opening degree of the second motor-operated valve is controlled so as to be greater than the opening degree of the first motor-operated valve when the first detecting element detects the predetermined pre-flooding state of refrigerant in the first high-pressure receiver, when the excess refrigerant distribution control is performed, the controller does not close the first motor-operated valve even when the first detecting element detects the predetermined pre-flooding state of refrigerant in the first high-pressure receiver, and does not close the second motor-operated valve even when the second detecting element detects the predetermined pre-flooding state of refrigerant in the second high-pressure receiver.

2. The refrigeration apparatus according to claim 1, wherein the first heat-source unit has a first heating element arranged and configured to heat refrigerant Which has passed through the first motor-operated valve in the first bypass channel, and a first bypass temperature detecting part arranged and configured to detect a temperature of the refrigerant after the refrigerant is heated by the first heating element in the first bypass channel, the second heat-source unit has a second heating element arranged and configured to heat refrigerant which has passed through the second motor-operated valve in the second bypass channel, and a second bypass temperature detecting part arranged and configured to detect a temperature of the refrigerant after the refrigerant is heated by the second heating element in the second bypass channel, and the controller controls the opening degree of the first motor-operated valve and the second motor-operated valve so that the refrigerant heated by the second heating element in the second bypass channel has a predetermined degree of superheat based on the temperature detected by the second bypass temperature detecting part while the refrigerant heated by the first heating element in the first bypass channel has a predetermined degree of superheat based on the temperature detected by the first bypass temperature detecting part.

3. The refrigeration apparatus according to claim 2, wherein the first detecting element has a first liquid level detecting channel extending from a part below an end part of the first bypass channel on a side thereof toward the first high-pressure receiver, the first liquid level detecting channel merging with the first bypass channel at a position upstream from a position at which the first bypass temperature detecting part is provided, and the second detecting element has a second liquid level detecting channel extending from a part below an end part of the second bypass channel on a side thereof toward the second high-pressure receiver, the second liquid level detecting channel merging with the second bypass channel at a position upstream from a position at which the second bypass temperature detecting part is provided.

4. The refrigerating apparatus according to claim 1, wherein the controller performs a normal operation mode in which the first motor-operated valve and the second motor-operated valve are both fully closed, and an excess refrigerant control mode in which at least one of the first motor-operated valve and the second motor-operated valve is opened, and the excess refrigerant control mode is started when the degree of subcooling of refrigerant flowing through an outlet of the usage-side heat exchanger is equal to or greater than a predetermined value in a state in which the usage-side heat exchanger is functioning as a refrigerant condenser.

5. The refrigeration apparatus according to claim 1, wherein the first heat-source unit has a first heating element arranged and configured to heat refrigerant Which has passed through the first motor-operated valve in the first bypass channel, and a first bypass temperature detecting part arranged and configured to detect a temperature of the refrigerant after the refrigerant is heated by the first heating element in the first bypass channel, the second heat-source unit has a second heating element arranged and configured to heat refrigerant which has passed through the second motor-operated valve in the second bypass channel, and a second bypass temperature detecting part arranged and configured to detect a temperature of the refrigerant after the refrigerant is heated by the second heating element in the second bypass channel, and the controller controls the opening degree of the first motor-operated valve and the second motor-operated valve so that the refrigerant heated by the second heating element in the second bypass channel has a predetermined degree of superheat based on the temperature detected by the second bypass temperature detecting part, while the refrigerant heated by the first heating element in the first bypass channel has a predetermined degree of superheat based on the temperature detected by the first bypass temperature detecting part.

6. The refrigeration apparatus according to claim 5, wherein the first detecting element has a first liquid level detecting channel extending from a part below an end part of the first bypass channel on a side thereof toward the first high-pressure receiver, the first liquid level detecting channel merging with the first bypass channel at a position upstream from a position at which the first bypass temperature detecting part is provided, and the second detecting element has a second liquid level detecting channel extending from a part below an end part of the second bypass channel on a side thereof toward the second high-pressure receiver, the second liquid level detecting channel merging with the second bypass channel at a position upstream from a position at which the second bypass temperature detecting part is provided.

7. The refrigerating apparatus according to claim 6, wherein the controller performs a normal operation mode in which the first motor-operated valve and the second motor-operated valve are both fully closed, and an excess refrigerant control mode in which at least one of the first motor-operated valve and the second motor-operated valve is opened, and the excess refrigerant control mode is started when the degree of subcooling of refrigerant flowing through an outlet of the usage-side heat exchanger is equal to or greater than a predetermined value in a state in which the usage-side heat exchanger is functioning as a refrigerant condenser.

8. The refrigerating apparatus according to claim 5, wherein the controller performs a normal operation mode in which the first motor-operated valve and the second motor-operated valve are both fully closed, and an excess refrigerant control mode in which at least one of the first motor-operated valve and the second motor-operated valve is opened, and the excess refrigerant control mode is started when the degree of subcooling of refrigerant flowing through an outlet of the usage-side heat exchanger is equal to or greater than a predetermined value in a state in which the usage-side heat exchanger is functioning as a refrigerant condenser.

9. The refrigerating apparatus according to claim 1, wherein the controller performs a normal operation mode in which the first motor-operated valve and the second motor-operated valve are both fully closed, and an excess refrigerant control mode in which at least one of the first motor-operated valve and the second motor-operated valve is opened, and the excess refrigerant control mode is started when the degree of subcooling of refrigerant flowing through an outlet of the usage-side heat exchanger is equal to or greater than a predetermined value in a state in which the usage-side heat exchanger is functioning as a refrigerant condenser.

10. The refrigerating apparatus according to claim 3, wherein the controller performs a normal operation mode in which the first motor-operated valve and the second motor-operated valve are both fully closed, and an excess refrigerant control mode in which at least one of the first motor-operated valve and the second motor-operated valve is opened, and the excess refrigerant control mode is started when the degree of subcooling of refrigerant flowing through an outlet of the usage-side heat exchanger is equal to or greater than a predetermined value in a state in which the usage-side heat exchanger is functioning as a refrigerant condenser.

11. The refrigerating apparatus according to claim 2, wherein the controller performs a normal operation mode in which the first motor-operated valve and the second motor-operated valve are both fully closed, and an excess refrigerant control mode in which at least one of the first motor-operated valve and the second motor-operated valve is opened, and the excess refrigerant control mode is started when the degree of subcooling of refrigerant flowing through an outlet of the usage-side heat exchanger is equal to or greater than a predetermined value in a state in which the usage-side heat exchanger is functioning as a refrigerant condenser.

* * * * *